US008651189B1

(12) United States Patent
Milanovich

(10) Patent No.: US 8,651,189 B1
(45) Date of Patent: Feb. 18, 2014

(54) BLOWOUT RECOVERY VALVE

(71) Applicant: Philip John Milanovich, Phoenix, AZ (US)

(72) Inventor: Philip John Milanovich, Phoenix, AZ (US)

(73) Assignee: Milanovich Investments, L.L.C., Phoenix, AZ (US)

( * ) Notice: Subject to any disclaimer, the term of this patent is extended or adjusted under 35 U.S.C. 154(b) by 0 days.

(21) Appl. No.: 13/933,128

(22) Filed: Jul. 2, 2013

(51) Int. Cl.
*E21B 34/00* (2006.01)

(52) U.S. Cl.
USPC ..... 166/351; 166/335; 166/343; 166/361; 166/364; 166/379; 405/52

(58) Field of Classification Search
USPC ..... 166/335, 343, 344, 351, 361, 364, 378, 166/379, 381; 405/60, 52
See application file for complete search history.

(56) References Cited

U.S. PATENT DOCUMENTS

| | | | | |
|---|---|---|---|---|
| 1,543,456 | A | 6/1925 | Stirling | |
| 3,681,923 | A * | 8/1972 | Hyde | 405/60 |
| 3,745,773 | A * | 7/1973 | Cunningham | 405/60 |
| 3,980,138 | A | 9/1976 | Knopik | |
| 4,220,207 | A | 9/1980 | Allen | |
| 4,301,827 | A | 11/1981 | Murthy et al. | |
| 4,376,467 | A | 3/1983 | Allen | |
| 4,440,523 | A | 4/1984 | Milgram et al. | |
| 4,456,071 | A * | 6/1984 | Milgram | 166/356 |
| 4,531,860 | A * | 7/1985 | Barnett | 405/60 |
| 4,568,220 | A | 2/1986 | Hickey | |
| 4,605,069 | A | 8/1986 | McClaflin et al. | |
| 4,790,936 | A * | 12/1988 | Renfrow | 210/242.3 |
| 4,969,676 | A | 11/1990 | LaMagna | |
| 5,012,854 | A | 5/1991 | Bond | |
| 5,199,496 | A | 4/1993 | Redus et al. | |
| 5,213,444 | A * | 5/1993 | Henning | 405/63 |
| 6,026,904 | A | 2/2000 | Burd et al. | |
| 6,059,040 | A | 5/2000 | Levitan et al. | |
| 6,119,779 | A | 9/2000 | Gipson et al. | |
| 6,601,888 | B2 | 8/2003 | McIlwraith et al. | |
| 7,987,903 | B1 | 8/2011 | Prado Garcia | |
| 8,016,030 | B1 | 9/2011 | Prado Garcia | |
| 8,205,678 | B1 | 6/2012 | Milanovich | |
| 8,418,767 | B1 | 4/2013 | Milanovich | |
| 8,434,558 | B2 * | 5/2013 | Swanson et al. | 166/368 |
| 8,555,979 | B1 * | 10/2013 | Milanovich | 166/354 |
| 2010/0171331 | A1 | 7/2010 | Jonas et al. | |
| 2013/0206421 | A1 * | 8/2013 | De Ghetto et al. | 166/357 |

* cited by examiner

*Primary Examiner* — Kenneth L Thompson
*Assistant Examiner* — Elizabeth Gitlin
(74) *Attorney, Agent, or Firm* — Swift & Swift, PLLC; Stephen C. Swift

(57) ABSTRACT removable blowout recovery valve. The large end of the valve (or funnel) is placed over a well pipe (or other pipe) through which oil (or other fluid) is flowing out. The small end of the valve is connected to a return pipe. A high pressure pipe with a smaller diameter is inserted into the well pipe. A sleeve connected to the return pipe is placed over the well pipe. A locking collar is attached to the sleeve. Positioning rings are attached to the high pressure pipe, that can fit inside the well pipe. A sharp edge extends from the sleeve, by which irregularities in the well pipe can be cut. Lasers or other cutting devices are attached to extension arms, that can also cut irregularities in the well pipe. The slope of the valve can be changed. The valve can be removed and raised with the aid of floats.

20 Claims, 26 Drawing Sheets

BLOWOUT RECOVERY VALVE

BACKGROUND OF THE INVENTION

1. Field of the Invention

The present invention relates to apparatus and methods for stopping and controlling the escape of fluid from wells or pipes.

2. Description of the Prior Art

As shown by recent events in the Gulf of Mexico, oil well blowouts are a serious threat to the environment, and can be very costly. There is a need for reliable devices for recovering from blowouts. None of the prior inventions discussed below are equivalent to the present invention.

U.S. Pat. No. 1,543,456 issued on Jun. 23, 1925, to Robert Stirling, discloses a blowout preventer, without the Bernoulli effect of the instant invention.

U.S. Pat. No. 3,980,138, issued on Sep. 14, 1976, to Duane L. Knopik, discloses an underground fluid recovery device, but does not disclose a funnel that is placed over a pipe from which fluid is escaping, as in the instant invention.

U.S. Pat. No. 4,220,207, issued on Sep. 2, 1980, to Neil W. Allen, discloses a sea floor diverter, without the use of the Bernoulli effect, as in the instant invention.

U.S. Pat. No. 4,301,827, issued on Nov. 24, 1981, to Rajam R. Murthy and Billy J. Rice, discloses a guided-float accumulator suitable for use with a hydraulic system for an oil well blowout preventer, using reaction forces that oppose Bernoulli effect forces, rather than making use of Bernoulli effect forces as in the instant invention.

U.S. Pat. No. 4,376,467, issued on Mar. 15, 1983, to Neil W. Allen, discloses a sea floor diverter, without the use of the Bernoulli effect, as in the instant invention.

U.S. Pat. No. 4,440,523, issued on Apr. 3, 1984, to Jerome H. Milgram and James Burgess, discloses a separating collector for subsea blowouts, but without air or other fluid being pumped down to create a Bernoulli effect, as in the instant invention.

U.S. Pat. No. 4,568,220, issued on Feb. 4, 1986, to John J. Hickey, discloses a system for capping and/or controlling undersea oil or gas well blowouts, but without the use of the Bernoulli effect, as in the instant invention.

U.S. Pat. No. 4,605,069, issued on Aug. 12, 1986, to McClafin et al., discloses a method for producing heavy, viscous crude oil, but it is not a blowout recovery device, as is the instant invention.

U.S. Pat. No. 4,969,676, issued on Nov. 13, 1990, to Joseph L. LaMagna, discloses an air pressure pick-up tool using the Bernoulli effect, but it is not a blowout recovery device, as is the instant invention.

U.S. Pat. No. 5,012,854, issued on May 7, 1991, to John A. Bond, discloses a pressure release valve for a subsea blowout preventer that is hydraulically operated, without making use of the Bernoulli effect as in the instant invention.

U.S. Pat. No. 5,199,496, issued on Apr. 6, 1993, to Clifford L. Redus and Peter L. Sigwardt, discloses a subsea pumping device incorporating a wellhead aspirator, using the Bernoulli effect, but does not disclose a funnel placed over a pipe from which fluid is escaping, as in the instant invention.

U.S. Pat. No. 6,026,904, issued on Feb. 22, 2000, to James A. Burd and Kenneth J. Huber, discloses a method and apparatus for commingling and producing fluids from multiple production reservoirs, but it is not a blowout recovery device, as is the instant invention.

U.S. Pat. No. 6,059,040, issued on May 9, 2000, to Leonid L. Levitan, Vasily V. Salygin and Vladimir D. Yurchenko, discloses a method and apparatus for the withdrawal of liquid from wellbores, but unlike the instant invention, it is not a blowout recovery device.

U.S. Pat. No. 6,119,779, issued on Sep. 19, 2000, to Larry Joe Gipson and Stephen Leon Carn, discloses a method and system for separating and disposing of solids from produced fluids, but unlike the instant invention, it is not a blowout recovery device.

U.S. Pat. No. 6,601,888, issued on Aug. 5, 2003, to Lon McIlwraith and Andrew Christie, discloses contactless handling of objects, using the Bernoulli effect, but unlike the instant invention, it is not a blowout preventer.

U.S. Pat. No. 7,987,903, issued on Aug. 2, 2011, to Jose Jorge Prado Garcia, discloses an apparatus and method for containing oil from a deep water oil well, but does not disclose the use of the Bernoulli effect, as in the instant invention.

U.S. Pat. No. 8,016,030, issued on Sep. 13, 2011, to Jose Jorge Prado Garcia, discloses an apparatus and method for containing oil from a deep water oil well, but does not disclose the use of the Bernoulli effect, as in the instant invention.

U.S. Patent Application Publication No. 2010/0171331, published on Jul. 8, 2010, to Stefan Jonas and Lutz Redmann, discloses a Bernoulli gripper for holding two-dimensional components such as silicon-based wafers, but it is not a blowout recovery device, as is the instant invention.

U.S. Pat. No. 8,205,678, issued on Jun. 26, 2012, U.S. Pat. No. 8,418,767, issued on Apr. 16, 2013, and U.S. patent application Ser. No. 13/837,065, filed on Mar. 15, 2013, all to Philip John Milanovich (the applicant therein), all disclose a blowout preventer with a Bernoulli Effect Suck-Down Valve. The instant invention is distinguishable, in that it discloses unique features, including a sleeve that is placed over the open end of the well pipe, and positioning rings attached to the high pressure pipe.

None of the above inventions and patents, taken either singly or in combination, is seen to describe the instant invention as claimed.

SUMMARY OF THE INVENTION

The present invention is a blowout recovery valve, including a large frustoconical funnel or valve, made of metal or other suitable material. The large end of the funnel is placed over a well pipe (or other pipe) through which oil (or natural gas or other fluid) is flowing out. The small end of the valve is connected to a return pipe. A high pressure (air separating) pipe with a smaller diameter is inserted into the well pipe. Air is pumped under high pressure through the high pressure pipe, separating the oil and forcing the oil that is not kept down in the well pipe by the pressure up through the return pipe. The funnel or valve is aligned and held in alignment by cylindrical positioning rings of varying diameters (that may also have varying heights and shapes). The funnel and valve are kept on the well pipe by one or more of the following: a sleeve with a locking collar, positioning arms, turbines, propellers, and the Bernoulli effect, as well as pressure from the surrounding sea water. Sonar, or lights and cameras, may be used to locate the well pipe so that the funnel or valve can be attached to it. A first gasket at the top end of the channel prevents leaks. Channels and rotating turbines near the top of the valve and rotating propeller blades on or near the end of the high pressure (air separating) pipe accelerate the flow, reducing pressure and increasing the suction due to the Bernoulli effect. The suction due to the Bernoulli effect, the rotating propeller blades and stacked turbines results in the sucking down of the funnel into the oil flowing from the pipe, as the increased velocity of the oil acts like the thrust of a ram jet, forcing the funnel and valve down onto the well pipe. In underwater applications, the added pressure provided by the water to the outside of the funnel will also aid in the attachment of the funnel to the well pipe. At a depth of one mile below the surface of the sea, the water pressure is 2,300 to 2,500 pounds per square inch.

The first Continuation-In-Part included the following additional features: 1. Jets by which the funnel may be moved into alignment with the well pipe. 2. Sensing devices on moveable arms. 3. A stopper that may be forced into the well pipe. 4. One-way valves in the stopper. 5. Stacked turbines in the return pipe. 6. A second gasket with pivoting overlapping plates.

The second Continuation-In-Part included the following additional features: 1. Positioning arms by which the funnel and stopper may be moved into alignment with the well pipe. 2. Propellers at or near the end of the high pressure (air separating) pipe accelerate the flow of oil and increase the suck-down effect.

The present application is an original application, and does not claim priority from the inventor's prior applications, even though they are discussed herein. It has the following new features, which distinguish it in a non-obvious manner from the above-mentioned prior applications of the inventor: 1. A sleeve, suitably dimensioned and configured to be placed over a portion of the well pipe adjacent to the open end of the well pipe, with the sleeve being connected to the return pipe. 2. A locking collar attached to the sleeve. 3. Cylindrical positioning rings attached to the high pressure pipe, that can fit inside the well pipe, and may have different diameters, heights and shapes, to help position the valve, funnel and sleeve onto the well pipe. 4. A sharp edge extending from the sleeve, by which irregularities in the well pipe can be cut. 5. Lasers or other cutting devices attached to extension arms, that can also cut irregularities in the well pipe. 6. The slope of the funnel can be changed. 7. The funnel and/or valve can be removed and raised to the surface with the aid of floats.

Accordingly, it is a first object of the invention to provide a blowout recovery valve that has moving parts.

It is a second object of the invention to provide a blowout recovery valve that has no moving parts.

It is a third object of the invention to provide a blowout recovery valve that is removable and recoverable.

It is a fourth object of the invention to provide a blowout recovery valve with a removable and recoverable funnel.

It is a fifth object of the invention to provide a blowout recovery valve that does not leave the well site.

It is a sixth object of the invention to provide a blowout recovery valve that is usable in deep water, in shallow water, and on land.

It is a seventh object of the invention to provide a blowout recovery valve that is safer to use than existing blowout recovery devices.

It is an eighth object of the invention to provide a blowout recovery valve that is more controllable.

It is a ninth object of the invention to provide a blowout recovery valve that is movable in all directions in three dimensions.

It is a tenth object of the invention to provide a blowout recovery valve that is more environmentally friendly and limits the environmental impact of blowouts.

It is an eleventh object of the invention to provide a blowout recovery valve with a lock-on collar.

It is a twelfth object of the invention to provide a blowout recovery valve with a collar is adjustable and removable.

It is a thirteenth object of the invention to provide a blowout recovery valve with considerably less mass and weight.

It is a fourteenth object of the invention to provide a blowout recovery valve with considerably less height and width.

It is a fifteenth object of the invention to provide a blowout recovery valve that is easy to ship and handle.

It is a sixteenth object of the invention to provide a blowout recovery valve that is reusable.

It is a seventeenth object of the invention to align the funnel and valve using cylindrical positioning rings.

It is an eighteenth object of the invention to provide a blowout recovery valve that limits liability.

It is a nineteenth object of the invention to provide a blowout recovery valve that is more cost effective.

It is a twentieth object of the invention to provide a blowout recovery valve with a floatation system that can cause it to float to the surface of a body of water.

It is a twenty-first object of the invention to provide a blowout recovery valve that can be flattened out.

It is a twenty-second object of the invention to provide a blowout recovery valve with a jointed and seamed funnel.

It is an object of the invention to provide improved elements and arrangements thereof in an apparatus for the purposes described which is relatively inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a blowout recovery valve that may be used with oil or gas wells, under the sea or on land.

Figure 1:
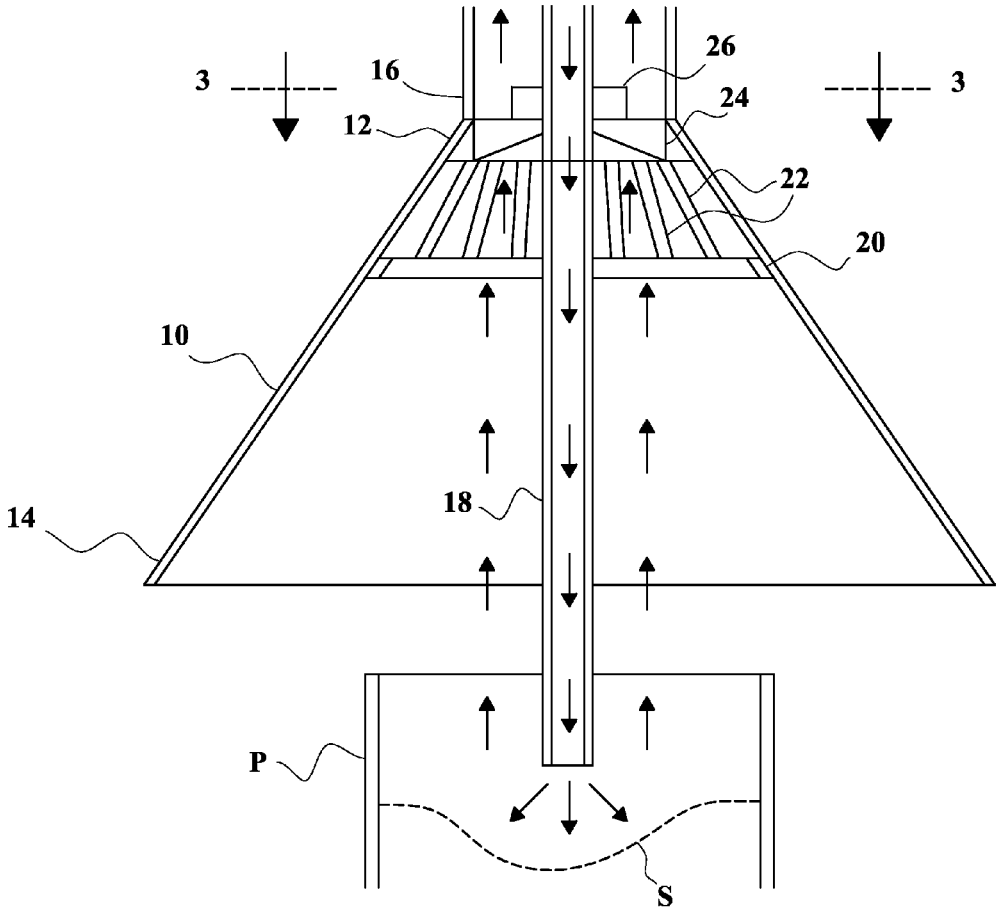
FIG. 1 is a vertical sectional view drawn along lines 1-1 of FIG. 3, showing the first preferred embodiment of the invention before the valve is sucked down onto the pipe from which the first fluid is escaping.
Figure 3:
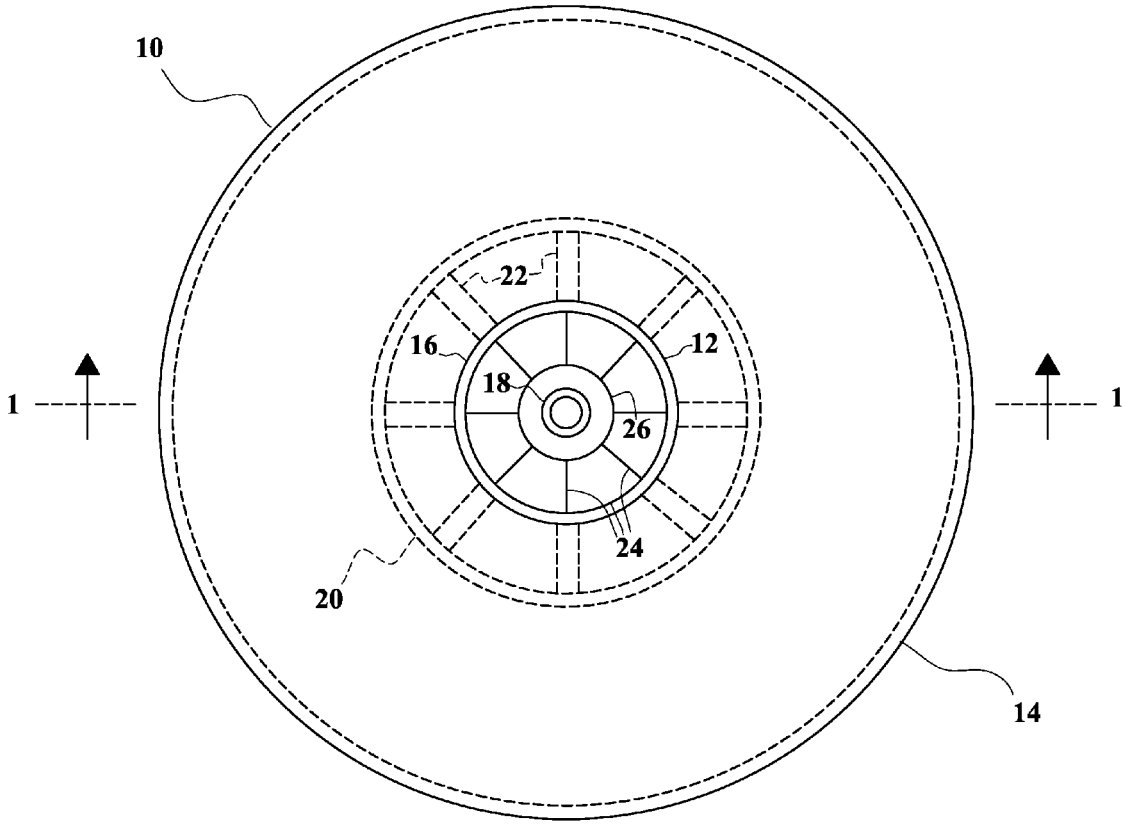
FIG. 3 is a horizontal sectional view drawn along lines 3-3 of FIG. 1, showing the first preferred embodiment of the invention.

The following are the features in the original patent application Ser. No. 12/960,495, filed on Dec. 4, 2010, now U.S. Pat. No. 8,205,678, issued on Jun. 26, 2012:

FIG. 1 is a vertical sectional view drawn along lines 1-1 of FIG. 3, showing the first preferred embodiment of the invention before the funnel 10 is sucked down onto the pipe P (which may be a well pipe or riser) from which a first fluid (such as petroleum) is escaping. The funnel has a hollow frustoconical shape, and has a smaller end 12 and a larger end 14 that is suitably dimensioned and configured to be placed over the pipe. A return pipe 16 is connected to the smaller end of the funnel. A high pressure pipe 18 passes through the return pipe and the funnel, and is suitably dimensioned and configured to be inserted into the pipe P. A second fluid (such as air) is pumped through the high pressure pipe at a pressure greater than that of the first fluid, causing the first fluid to be separated by the second fluid in a space S adjacent to an end of the high pressure pipe that has been inserted into the pipe through which the first fluid is escaping. A portion of the first fluid that is not held back by the greater pressure of the second fluid will flow through the valve and the return pipe at an accelerated velocity, but at a reduced pressure due to the Bernoulli effect, thus helping to suck the valve down onto the pipe P.

Figure 2:
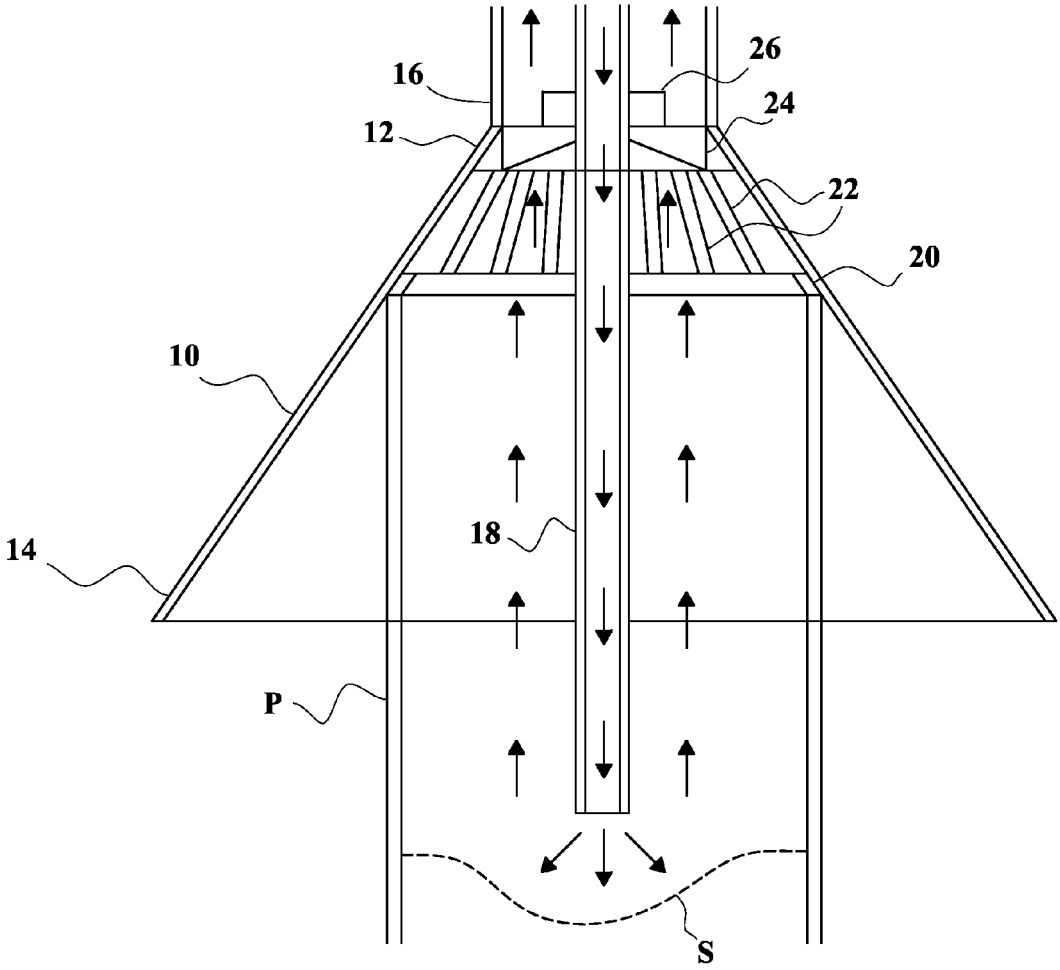
FIG. 2 is a vertical sectional view drawn along lines 1-1 of FIG. 3, showing the first preferred embodiment of the invention after the valve is sucked down onto the pipe from which the first fluid was escaping.

FIG. 2 is a vertical sectional view drawn along lines 1-1 of FIG. 3, showing the first preferred embodiment of the invention after the valve is sucked down onto the pipe P from which the first fluid was escaping. A first gasket 20 within the valve prevents the first and second fluids from leaking out between the valve and the pipe P. Inside the valve, adjacent to its smaller end, there are channels 22 to further accelerate the flow of the first and second fluids toward the return pipe. (The channels may be small pipes.) Adjacent to the smaller end of the valve there is a turbine comprising blades 24 driven by motor 26, that can rotate to further accelerate the flow of the first and second fluids through the return pipe. FIG. 3 is a horizontal sectional view drawn along lines 3-3 of FIG. 1, showing the first preferred embodiment of the invention.

Figure 4:
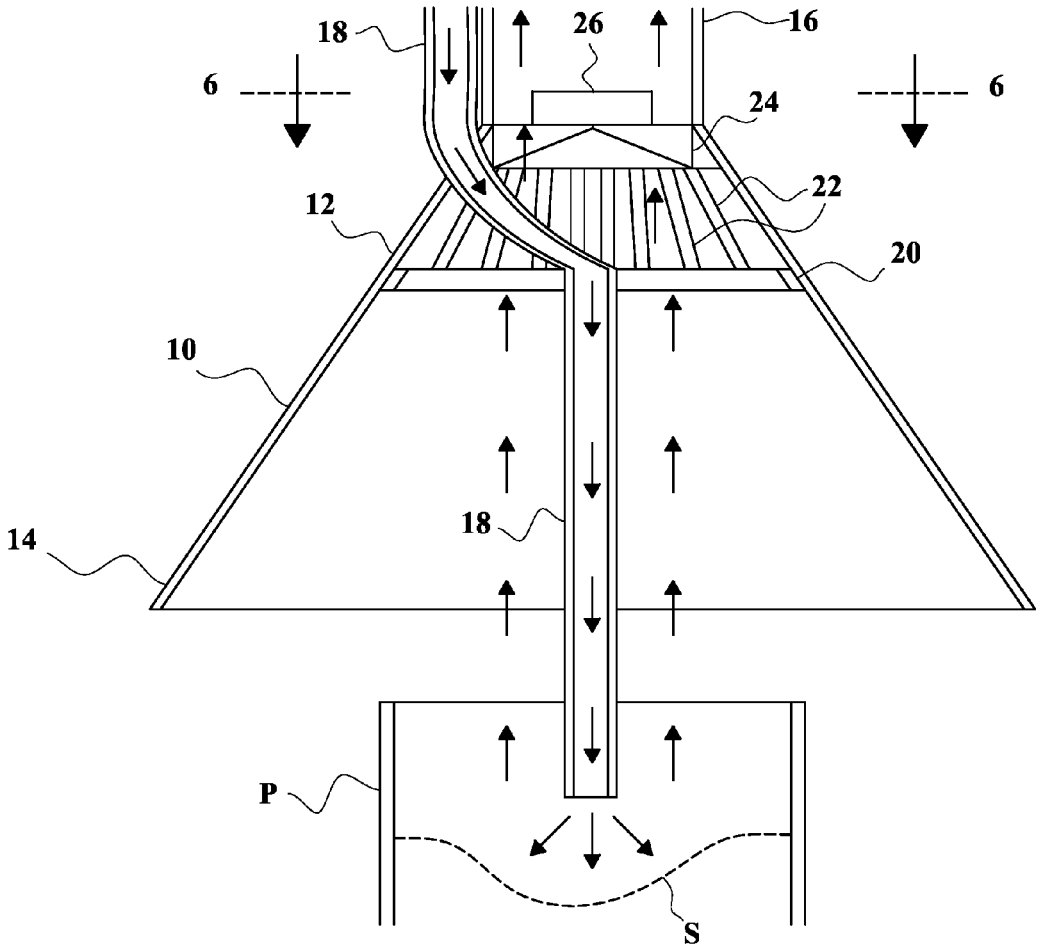
FIG. 4 is a vertical sectional view drawn along lines 4-4 of FIG. 6, showing the second preferred embodiment of the invention before the valve is sucked down onto the pipe from which the first fluid is escaping.
Figure 5:
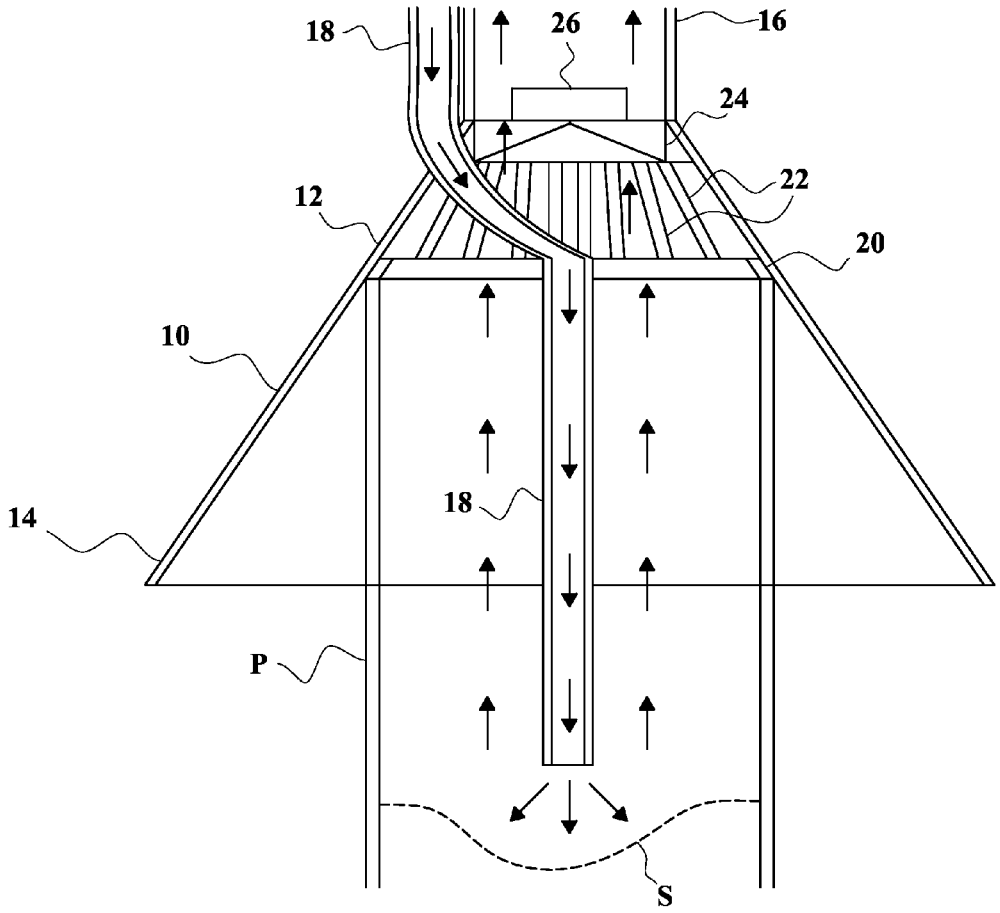
FIG. 5 is a vertical sectional view drawn along lines 4-4 of FIG. 6, showing the second preferred embodiment of the invention after the valve is sucked down onto the pipe from which the first fluid was escaping.
Figure 6:
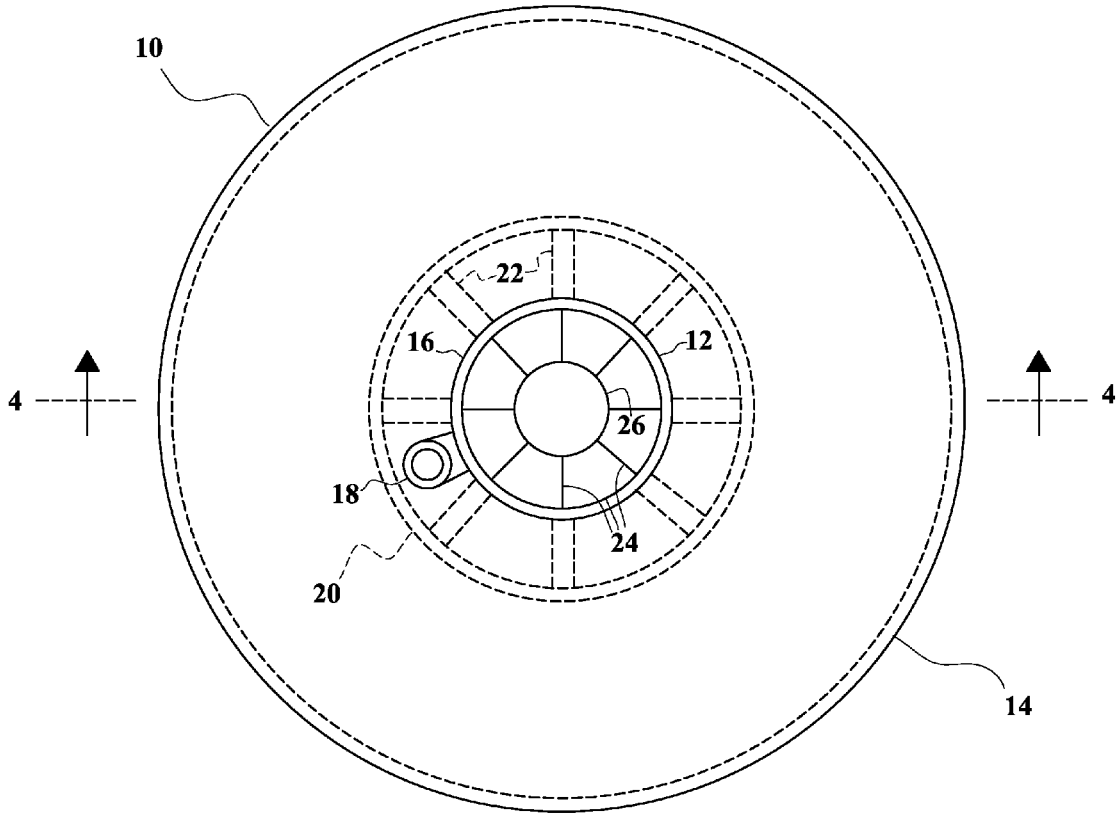
FIG. 6 is a horizontal sectional view drawn along lines 6-6 of FIG. 4, showing the second preferred embodiment of the invention.

FIG. 4 is a vertical sectional view drawn along lines 4-4 of FIG. 6, showing the second preferred embodiment of the invention before the valve is sucked down onto the pipe from which the first fluid is escaping, which is the same as the first preferred embodiment, except that the high pressure pipe 18 is in an alternative position, passing outside the return pipe 16 and through a side of the valve 10. FIG. 5 is a vertical sectional view drawn along lines 4-4 of FIG. 6, showing the second preferred embodiment of the invention after the valve is sucked down onto the pipe from which the first fluid was escaping. FIG. 6 is a horizontal sectional view drawn along lines 6-6 of FIG. 4, showing the second preferred embodiment of the invention.

Figure 7:
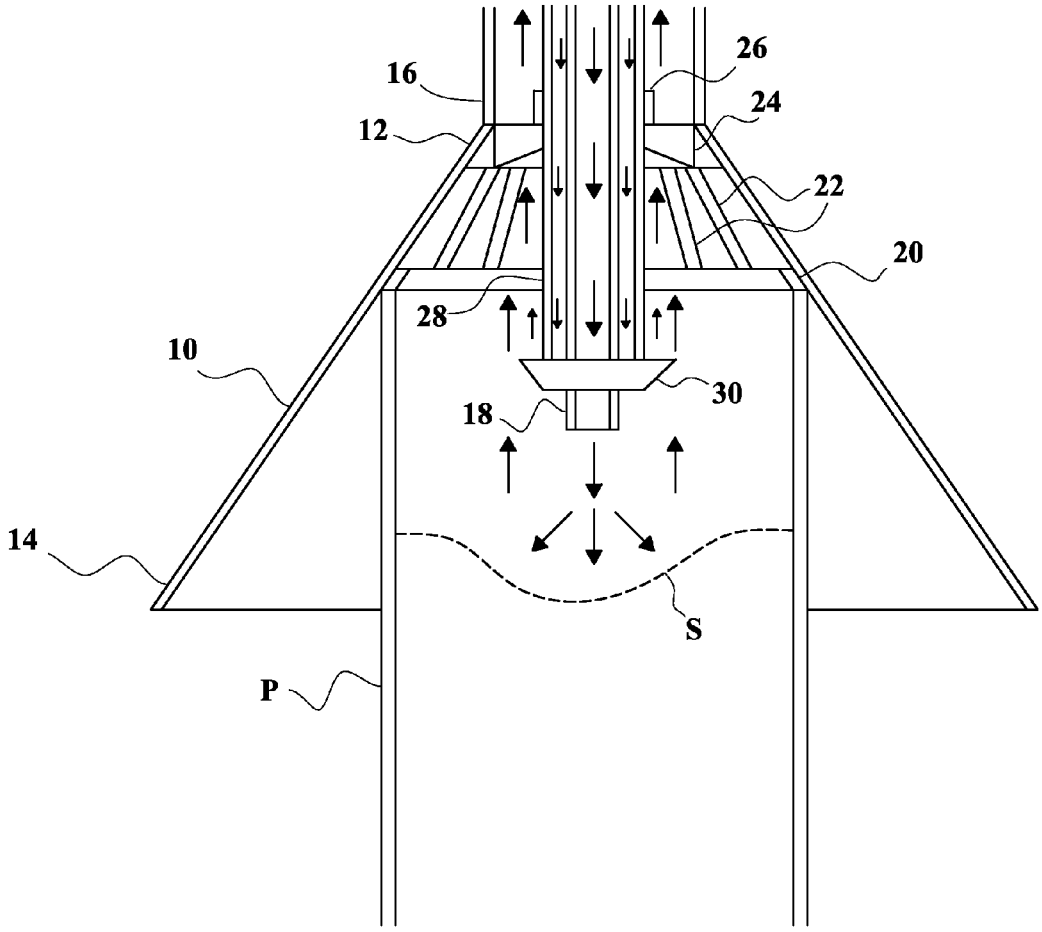
FIG. 7 is a vertical sectional view of the third preferred embodiment of the invention.

FIG. 7 is a vertical sectional view of the third preferred embodiment of the invention, in which there is a secondary air supply 28 with valve 30, that can be used to keep the blades 24 turning. The high pressure pipe 18 is shown retracted back up into the valve, which is also a means of keeping the blades turning.

Figure 8:
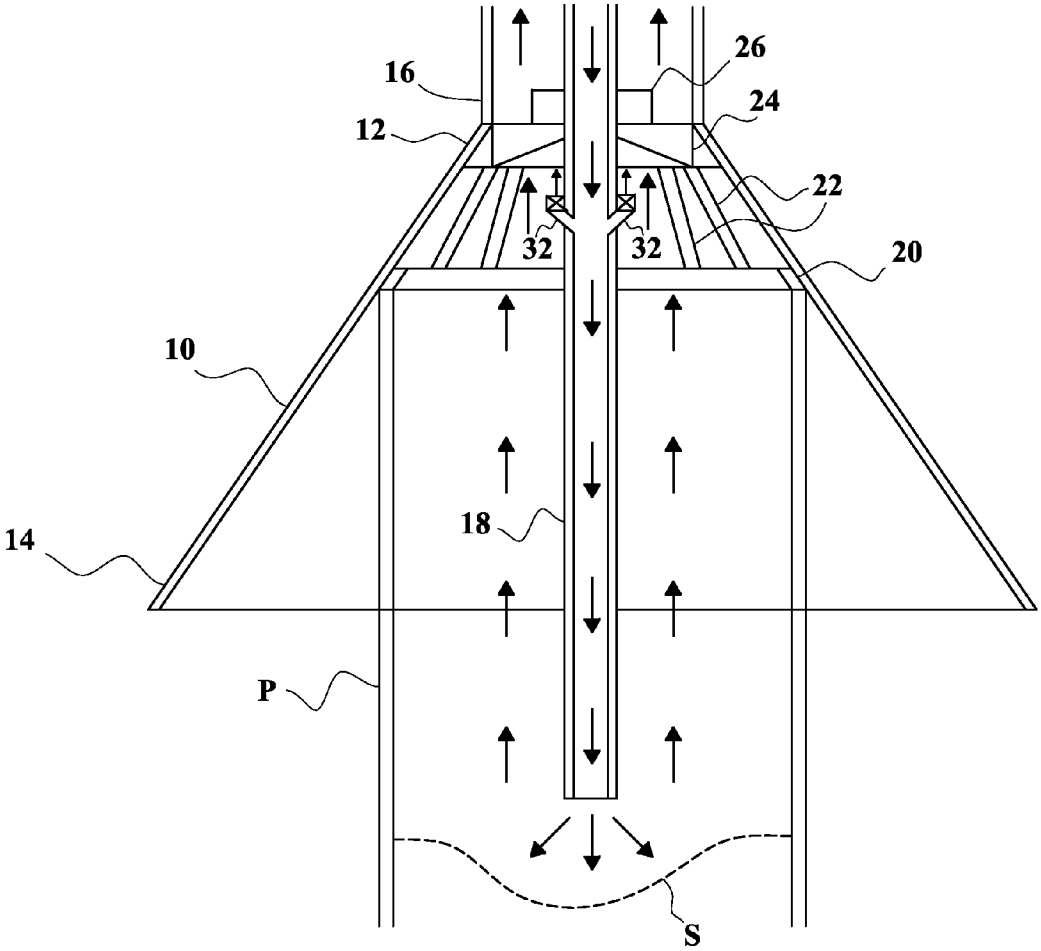
FIG. 8 is a vertical sectional view of the fourth preferred embodiment of the invention.

FIG. 8 is a vertical sectional view of the fourth preferred embodiment of the invention, in which there are valves 32 in the high pressure pipe 18 just below the blades 24 that can keep the blades turning. Note that the valve can be sucked down both by pressure from the well, and by pressure from outside sources (that supply air to the high pressure pipe or a secondary air supply or electricity or fuel to the motor 26.)

The following were the new features in the first Continuation-In-Part, patent application Ser. No. 13/533,964, filed on Jun. 26, 2012, now U.S. Pat. No. 8,418,767, issued on Apr. 16, 2013, which is a fifth preferred embodiment of the invention, shown in FIGS. 9-13:

1. Jets 34 (shown in FIGS. 9, 10 and 11) on an exterior surface of the valve 10, through which a second fluid may be released to move the valve into alignment with the pipe P through which the first fluid is escaping. The second fluid is supplied to the jets through a second high pressure pipe 36 with branches 37, and the jets each have a plurality of nozzles 38 that point in different directions. The second fluid will usually be air, and the air may be supplied through a compressed air pipe. (Alternatively, electric motors may be used to move the valve.)

2. Sensing devices 40 selected from the group comprising lights and cameras, sonar, and global positioning system devices, on movable arms 42 (shown in FIGS. 9, 10 and 11) that can be extended from the valve, by which the position of the valve relative to the pipe through which the first fluid is escaping can be determined, so that it can be moved into alignment with said pipe using the jets (or motors). The arms may be moved between an extended position (shown in solid lines) and retracted position (shown in broken lines). The arms will generally be in an extended position when the sensing devices are used. There may be two arms, each moved by a motor 44, than can each rotate 180 degrees, giving 360 degree coverage of the surrounding area.

3. A stopper or plug 46 (shown in FIGS. 9 and 10) surrounding a portion of the high pressure pipe 18 inside the valve, the stopper having an upper portion 48 with a diameter that is the same as the interior diameter of the pipe through which the first fluid is escaping, and a sloping lower portion 50, and a piston 52 that can push the stopper down into the pipe though which the first fluid is escaping. The lower portion must be smaller than the diameter of the pipe P, so that it can enter the pipe to a sufficient distance to close off the flow of the first fluid. The sloping or tapered shape of the lower portion may help in positioning the valve and stopper onto pipe P, as well as helping to seal off the flow of the first fluid. The high pressure pipe must, of course, have a smaller diameter that the pipe through with the first fluid is escaping. The piston may be moved by an explosive charge, hydraulics, compressed air, electricity, springs, or any other suitable means. The stopper increases the Bernoulli effect by its shape and position in the valve. One-way locks 54 may prevent the stopper from being destroyed by the flow of the first fluid and pressure.

4. One-way valves 56, (shown in FIGS. 9 and 10) through which the second fluid can be released through a portion of the high pressure pipe inside the valve, to increase the Bernoulli effect, while preventing the first fluid from escaping. The one-way valves pass through the walls of the high pressure pipe and the stopper. The one-way valves allow the second fluid (e.g., air) to enter the pipe through which the first fluid (e.g., oil) is flowing, and stop the flow of the first fluid once the stopper is activated.

5. A plurality of turbines 57 (shown in FIGS. 9 and 10) in the return pipe 16 to accelerate the flow of the first fluid. The entire system, including the turbines, may be powered by air, electrical-wire, an electrical power pack, springs, or other suitable means. The turbines are stacked in the return pipe to increase suction.

6. A second gasket 58 (shown in FIGS. 9-11, and in detail in FIGS. 12 and 13) at the larger end of the valve, the gasket having a circular rim 60 from which extend overlapping plates 62 pivotally attached to the rim, wherein the plates can be simultaneously rotated from an open position (shown in FIGS. 9 and 12), in which they do not block the valve from being placed over the pipe from which the first fluid is escaping, to a closed position (shown in FIGS. 10 and 13), in which they contact said pipe and prevent the first fluid from escaping to the surrounding space. The gasket may be opened and closed by a draw string 64, a spring control spool powered by a battery pack, or any other suitable mechanism. The plates may be pivotally connected to the circular rim by springs or other suitable means.

Figure 14:
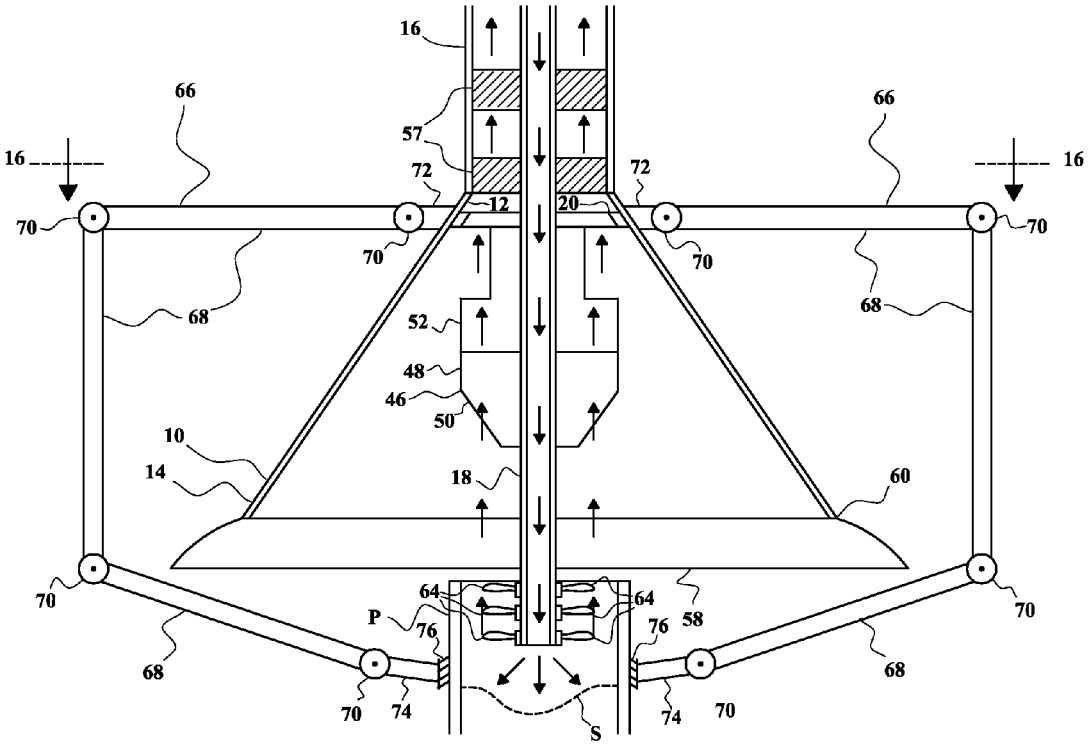
FIG. 14 is a vertical sectional view drawn along lines 14-14 of FIG. 16, showing the sixth preferred embodiment of the invention before the valve is sucked down onto the pipe from which the first fluid is escaping.
Figure 15:
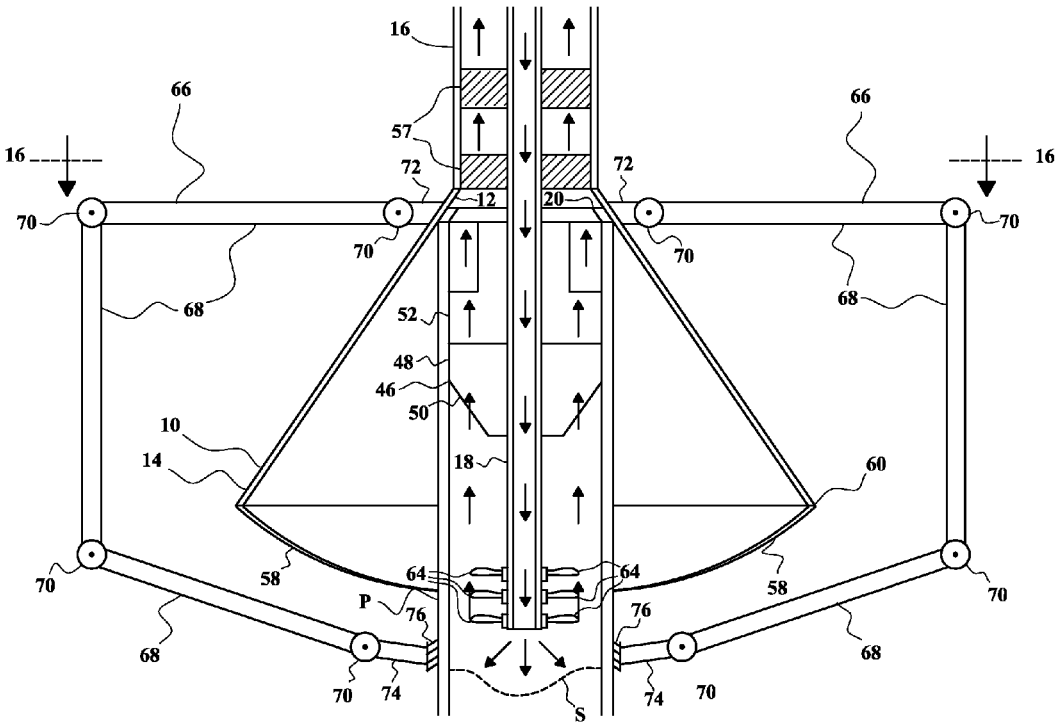
FIG. 15 is a vertical sectional view drawn along lines 14-14 of FIG. 16, showing the sixth preferred embodiment of the invention after the valve is sucked down onto the pipe from which the first fluid was escaping.
Figure 16:
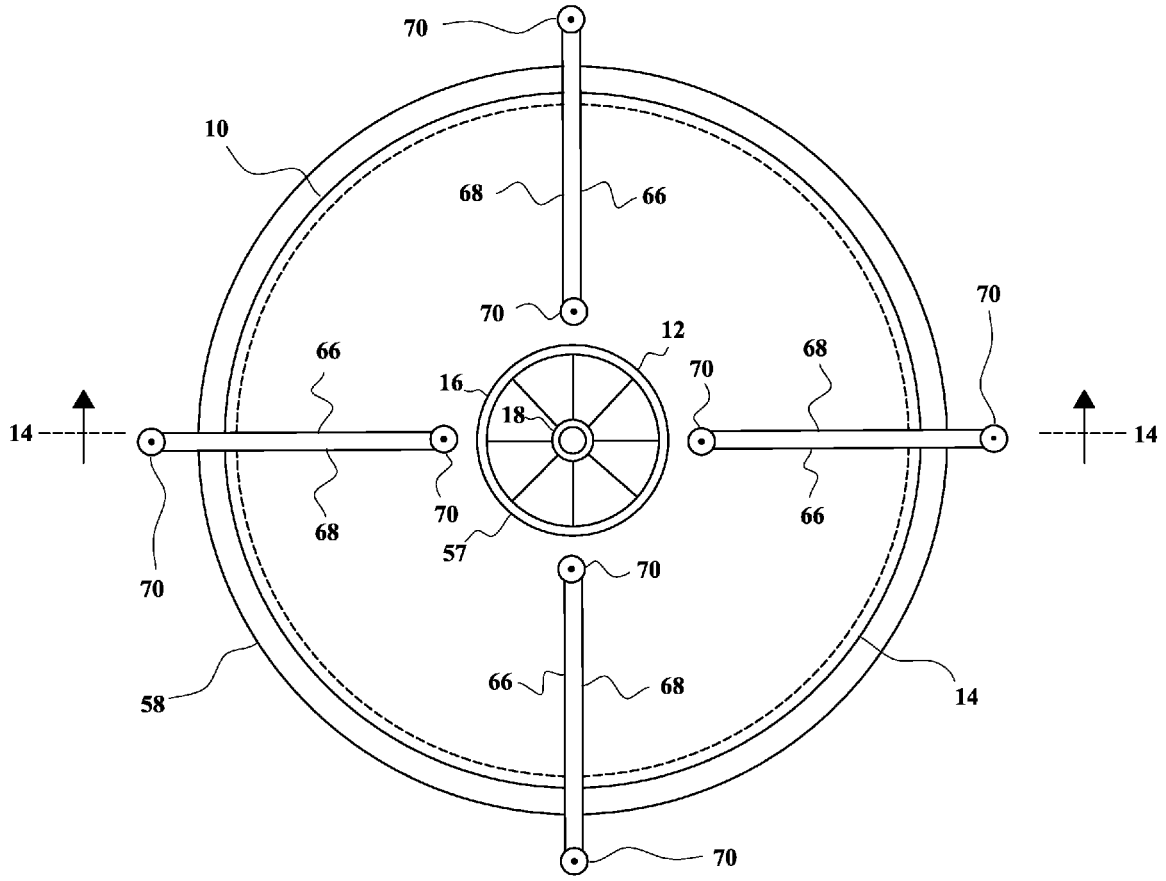
FIG. 16 is a horizontal sectional view drawn along lines 16-16 of FIG. 13, showing the sixth preferred embodiment of the invention.

The following were the new features in the second Continuation-In-Part, pending allowed patent application Ser. No. 13/837,065, filed on Mar. 15, 2013, which is a sixth preferred embodiment of the invention, shown in FIGS. 14-16:

1. Positioning arms 66 extending from the valve, said positioning arms being able to move the valve into alignment with the pipe through which the first fluid is escaping, and then to hold it in place. The positioning arms each have a plurality of segments 68, and the segments are connected by motor driven joints 70 by which they can be moved. The positioning arms each have an inner segment 72 attached to the valve. The positioning arms each have an outer segment 74 with a gripping surface 76. The tapering shape of the stopper may also aid the correct positioning of the valve and stopper onto the pipe P by the positioning arms. Once they are in position, the second gasket 58 can be closed around pipe P, as shown in FIG. 15.

2. Propellers 64 on or near the end of the high pressure (air separating) pipe, that can rotate to accelerate flow of the first fluid into the turbines 57, giving the system a ram jet effect, that works in combination with the Bernoulli effect. The propellers may also help move the stopper into the pipe through which the first fluid is escaping, and help keep the stopper in place.

Figure 9:
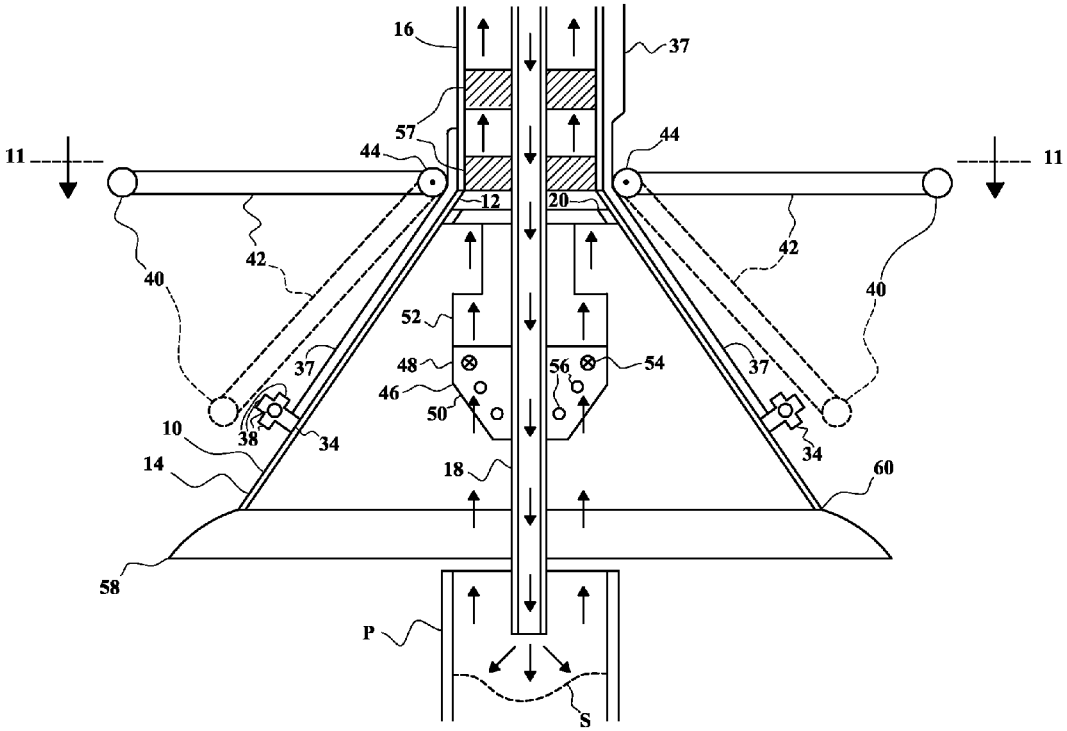
FIG. 9 is a vertical sectional view drawn along lines 9-9 of FIG. 3, showing the fifth preferred embodiment of the invention before the valve is sucked down onto the pipe from which the first fluid is escaping.
Figure 10:
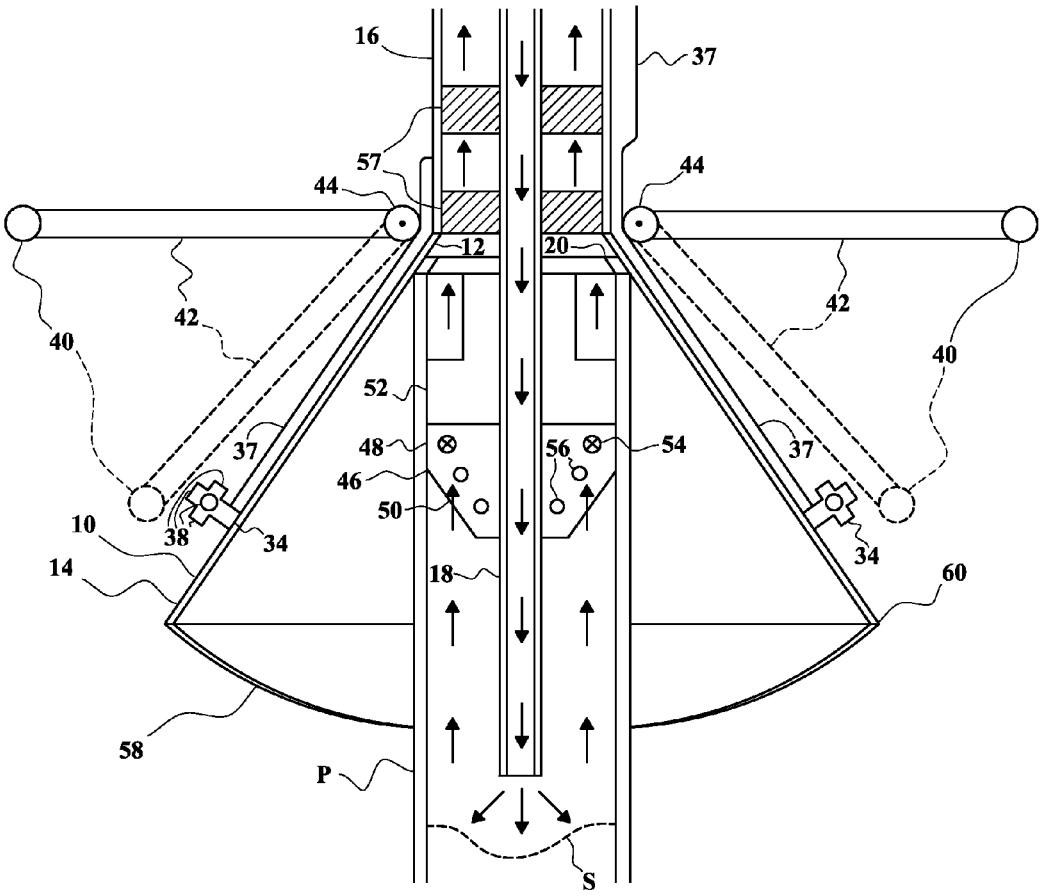
FIG. 10 is a vertical sectional view drawn along lines 9-9 of FIG. 3, showing the fifth preferred embodiment of the invention after the valve is sucked down onto the pipe from which the first fluid was escaping.
Figure 11:
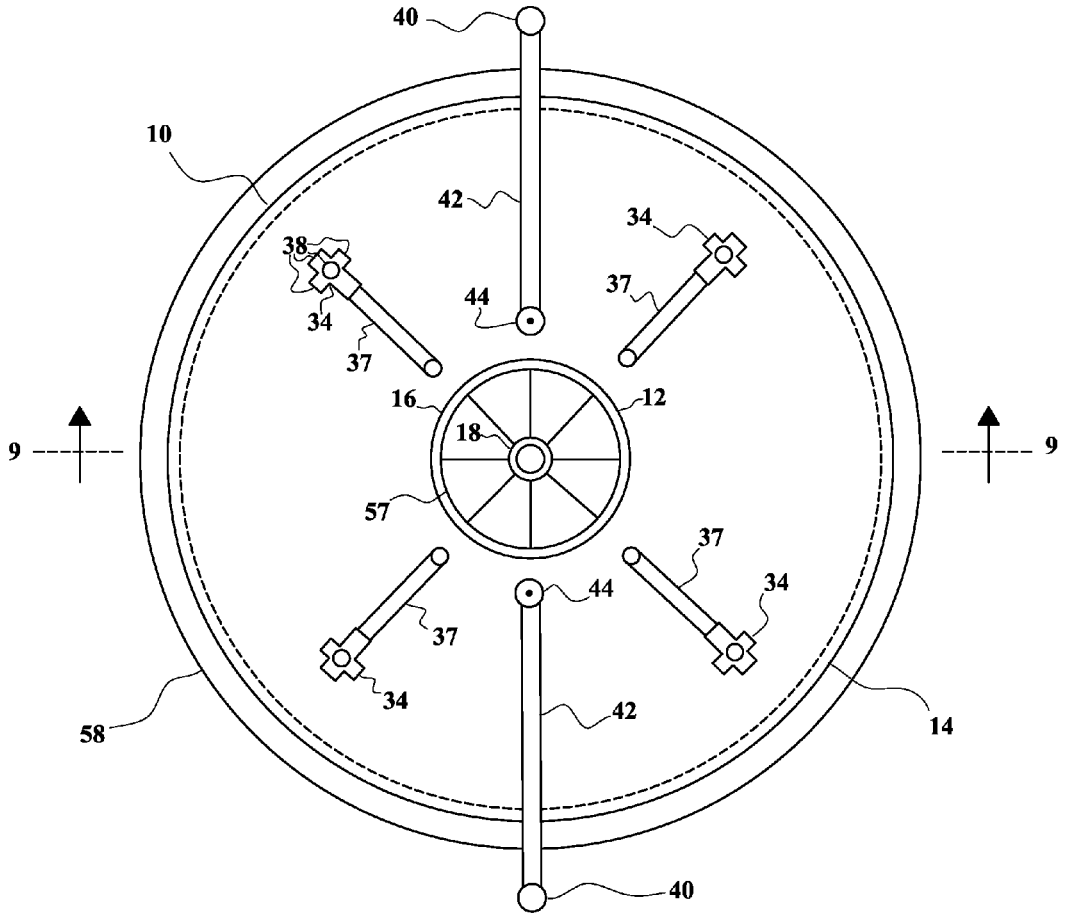
FIG. 11 is a horizontal sectional view drawn along lines 11-11 of FIG. 1, showing the fifth preferred embodiment of the invention.
Figure 12:
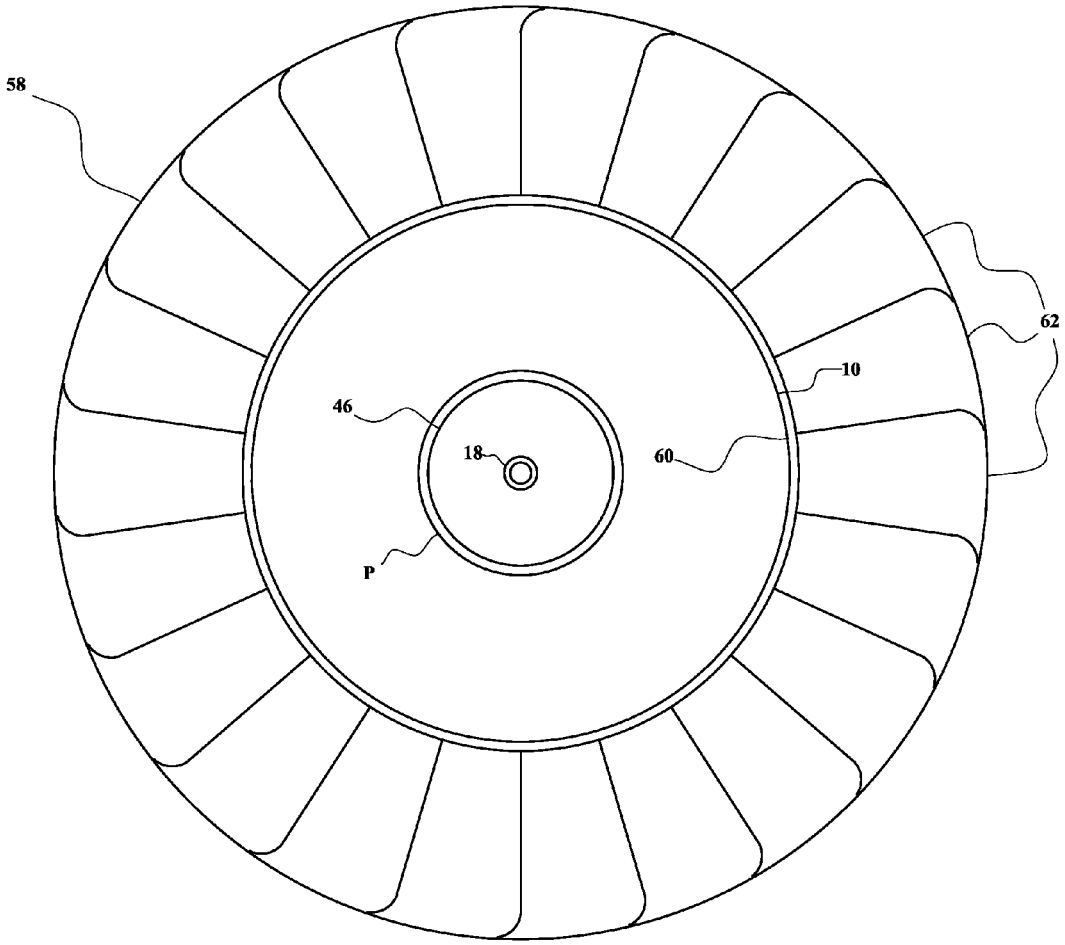
FIG. 12 is a detail view of the second gasket of the fifth preferred embodiment of the invention in an open position.
Figure 13:
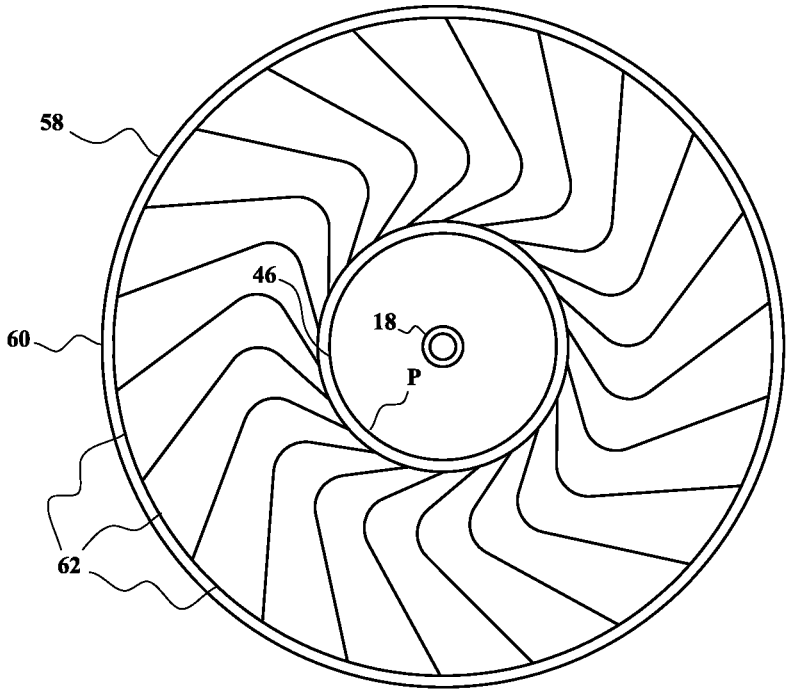
FIG. 13 is a detail view of the second gasket of the fifth preferred embodiment of the invention in a closed position.

3. Sensing devices (40 as shown in FIGS. 9, 10 and 11) selected from the group comprising lights and cameras, sonar, and global positioning system devices, can be attached to the positioning arms, by which the position of the valve relative to the pipe through which the first fluid is escaping can be determined, so that it can be moved into alignment with said pipe.

The various parts of the invention may be made of either rigid or flexible materials.

The following are the new features in the present application, which is filed as an original patent application without claiming priority from the above-mentioned applications, and which is a seventh preferred embodiment of the invention, shown in FIGS. 17-26.

1. Sleeve for Well Pipe

Figure 17:
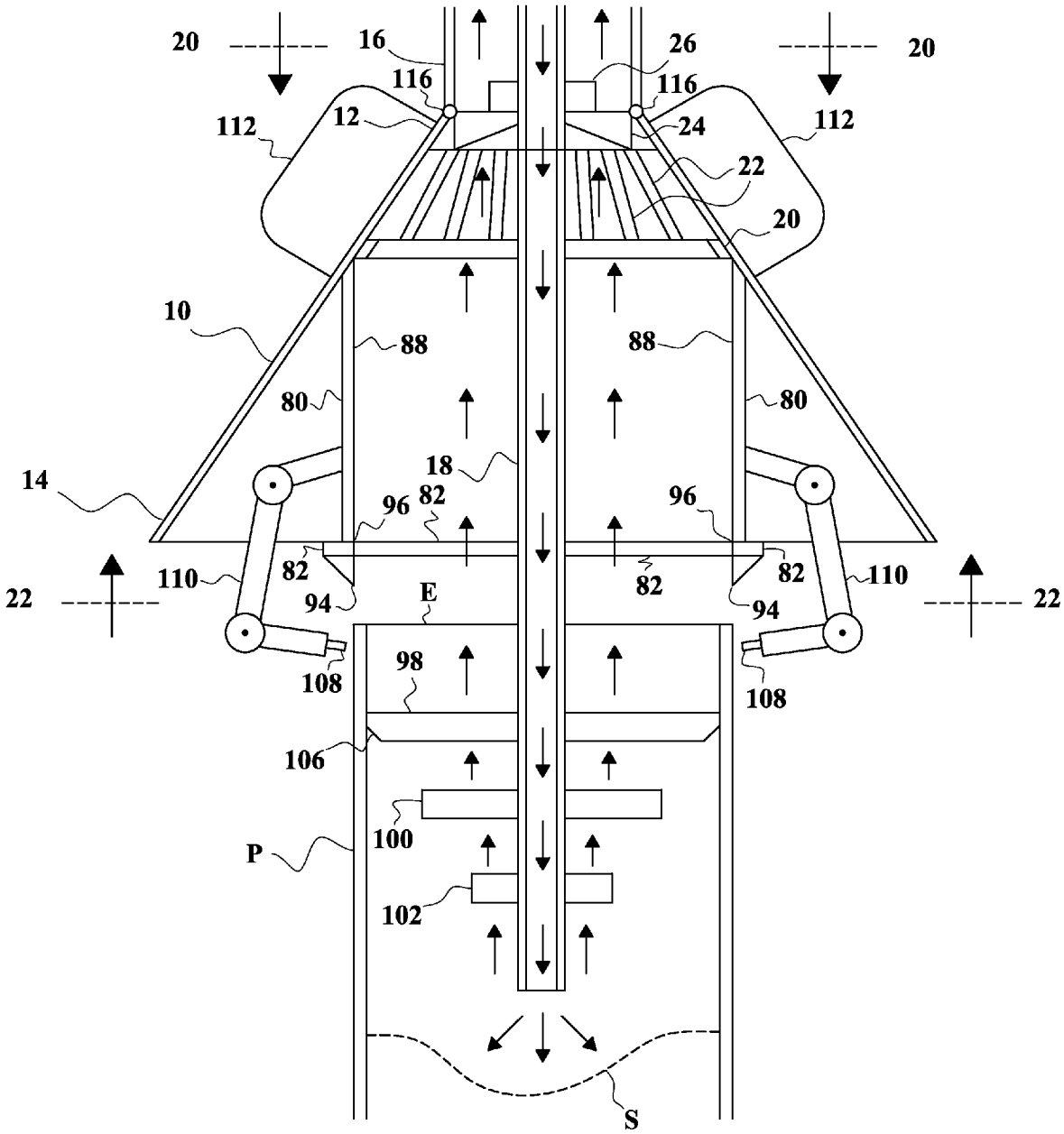
FIG. 17 is a vertical sectional view drawn along lines 17-17 of FIG. 20, showing the seventh preferred embodiment of the invention before the valve and sleeve are lowered down onto the well pipe.
Figure 18:
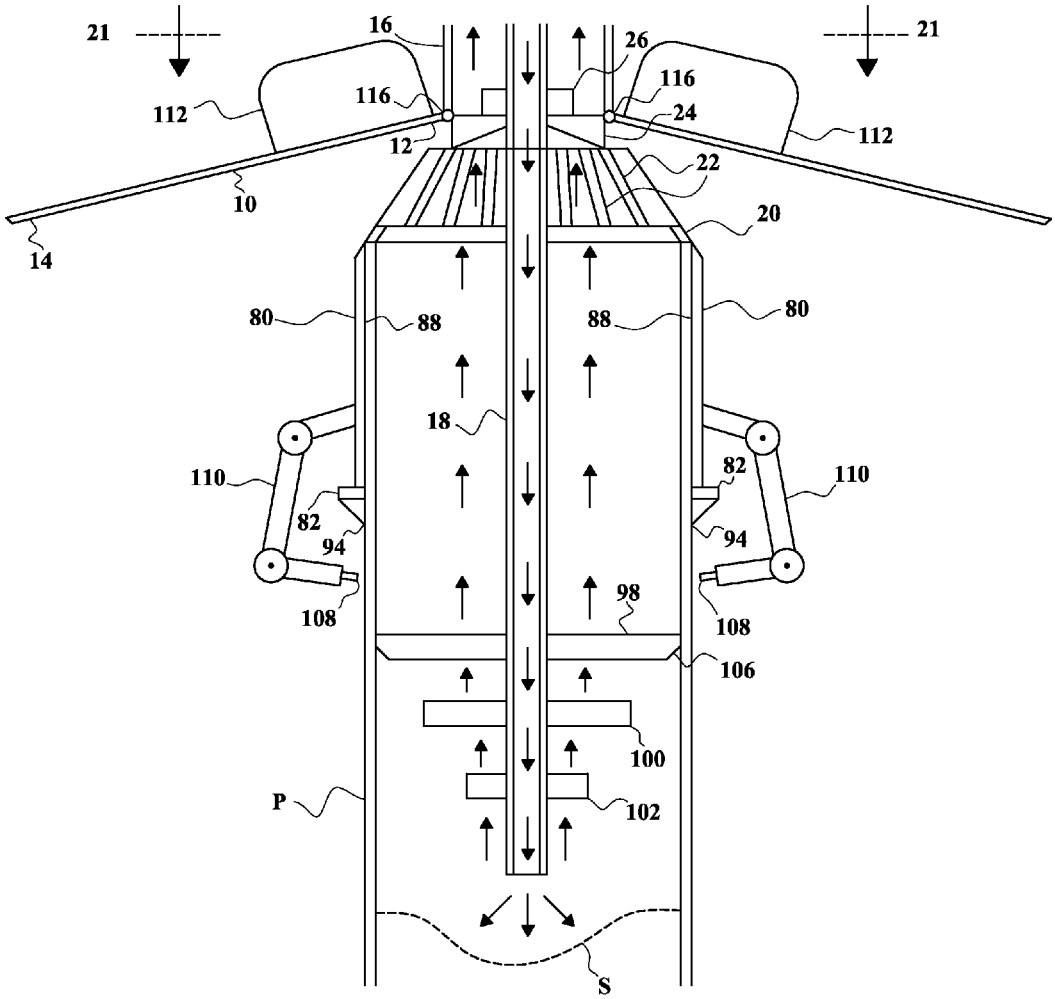
FIG. 18 is a vertical sectional view, showing the seventh preferred embodiment of the invention after the valve and sleeve are lowered down onto the well pipe.
Figure 19:
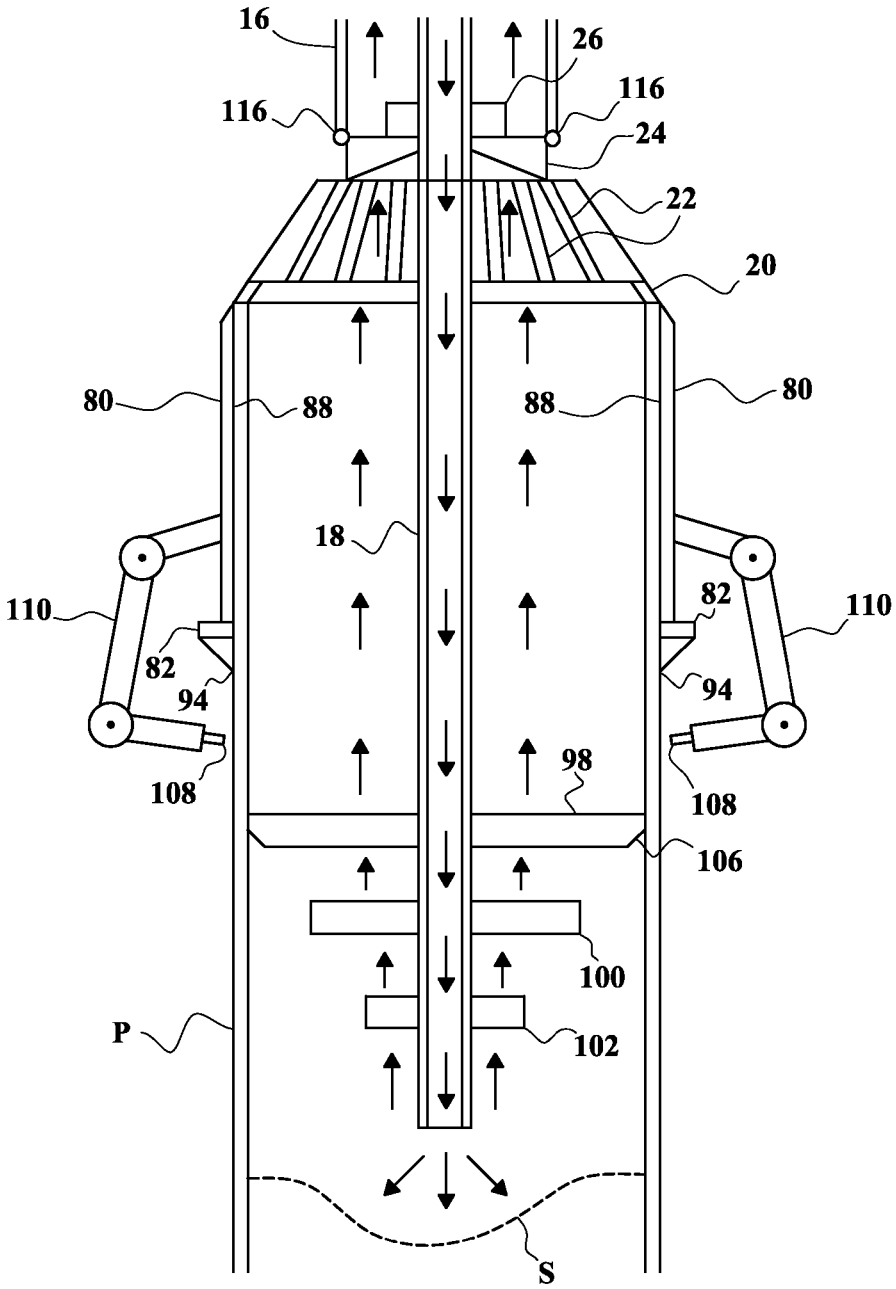
FIG. 19 is a vertical sectional, showing the seventh preferred embodiment of the invention after the valve and sleeve are lowered down onto the well pipe, and the funnel has been removed.
Figure 20:
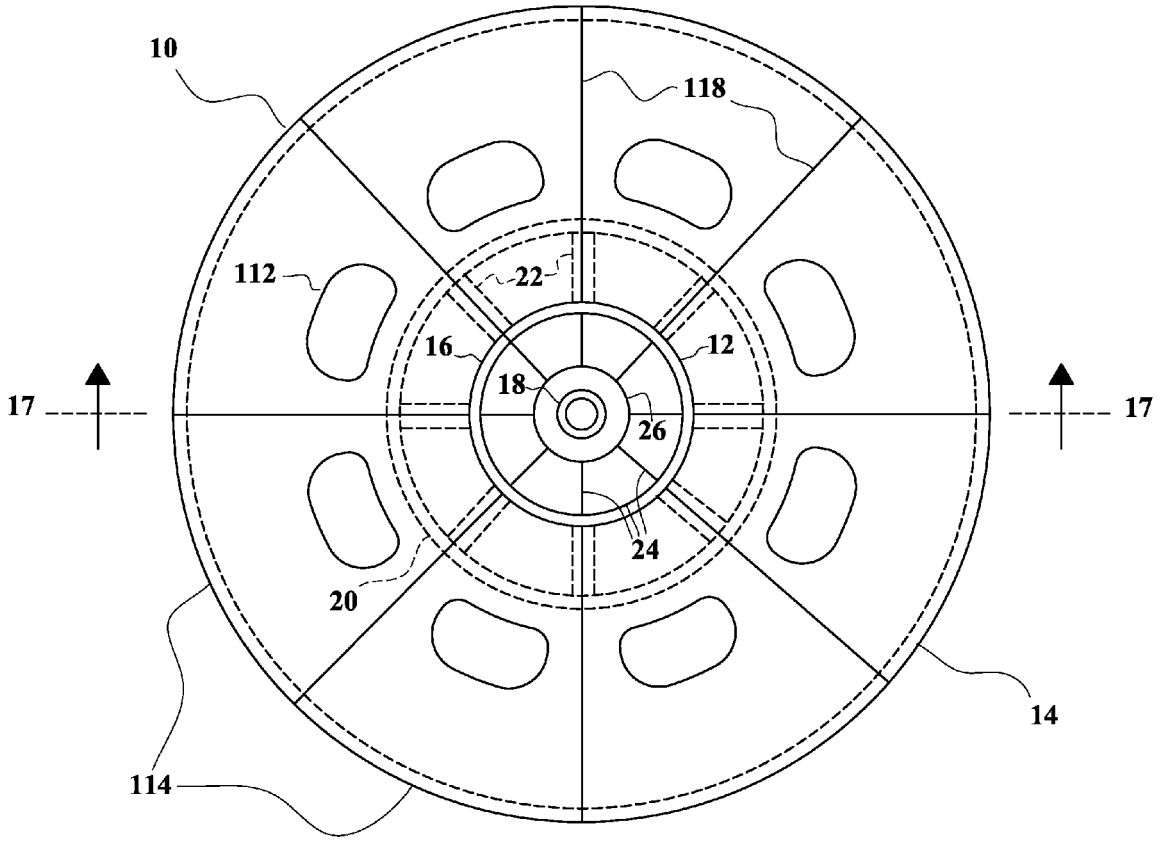
FIG. 20 is a horizontal sectional view drawn along lines 20-20 of FIG. 17, showing the seventh preferred embodiment of the invention, with the funnel in a lowered position.
Figure 21:
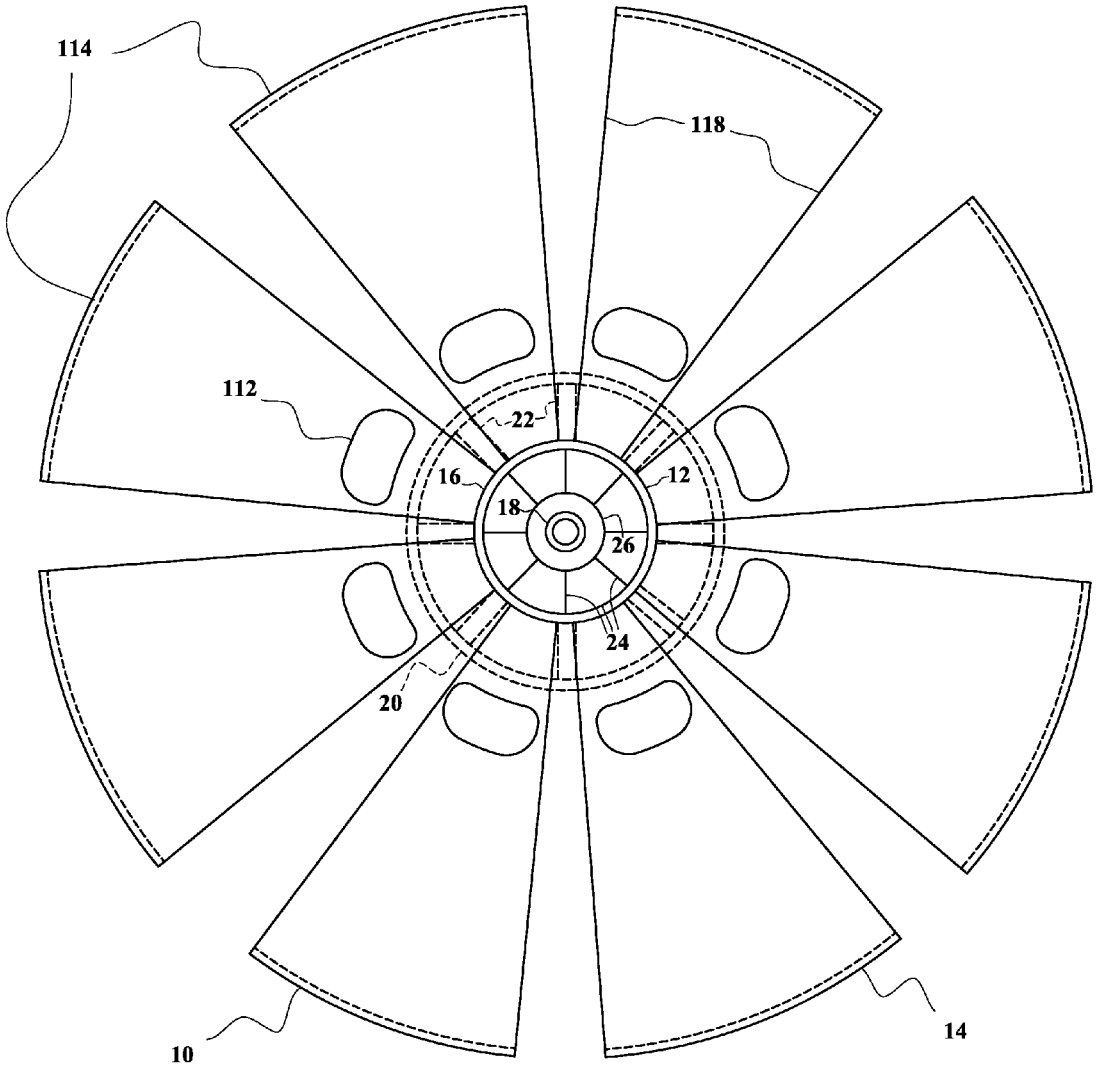
FIG. 21 is a horizontal sectional view drawn along lines 21-21 of FIG. 18, showing the seventh preferred embodiment of the invention, with the funnel in a raised position.

A sleeve (80 in FIGS. 17 and 18), is suitably dimensioned and configured to be placed over a portion of the well pipe P adjacent to the open end E of the well pipe, with the sleeve being connected to the return pipe 16. FIG. 17 shows the sleeve above the well pipe before it is placed over it. FIG. 18 shows the sleeve surrounding the top portion of the well pipe. A portion of the first fluid (e.g., oil) that is not held back by the greater pressure of the second fluid (e.g., air) will flow through the sleeve and then the return pipe. The sleeve may have two or more telescoping segments, or it may be in one piece without moving parts. The sleeve may be made of a rigid material with a fixed diameter, or of a flexible material with a variable diameter.

Figure 22:
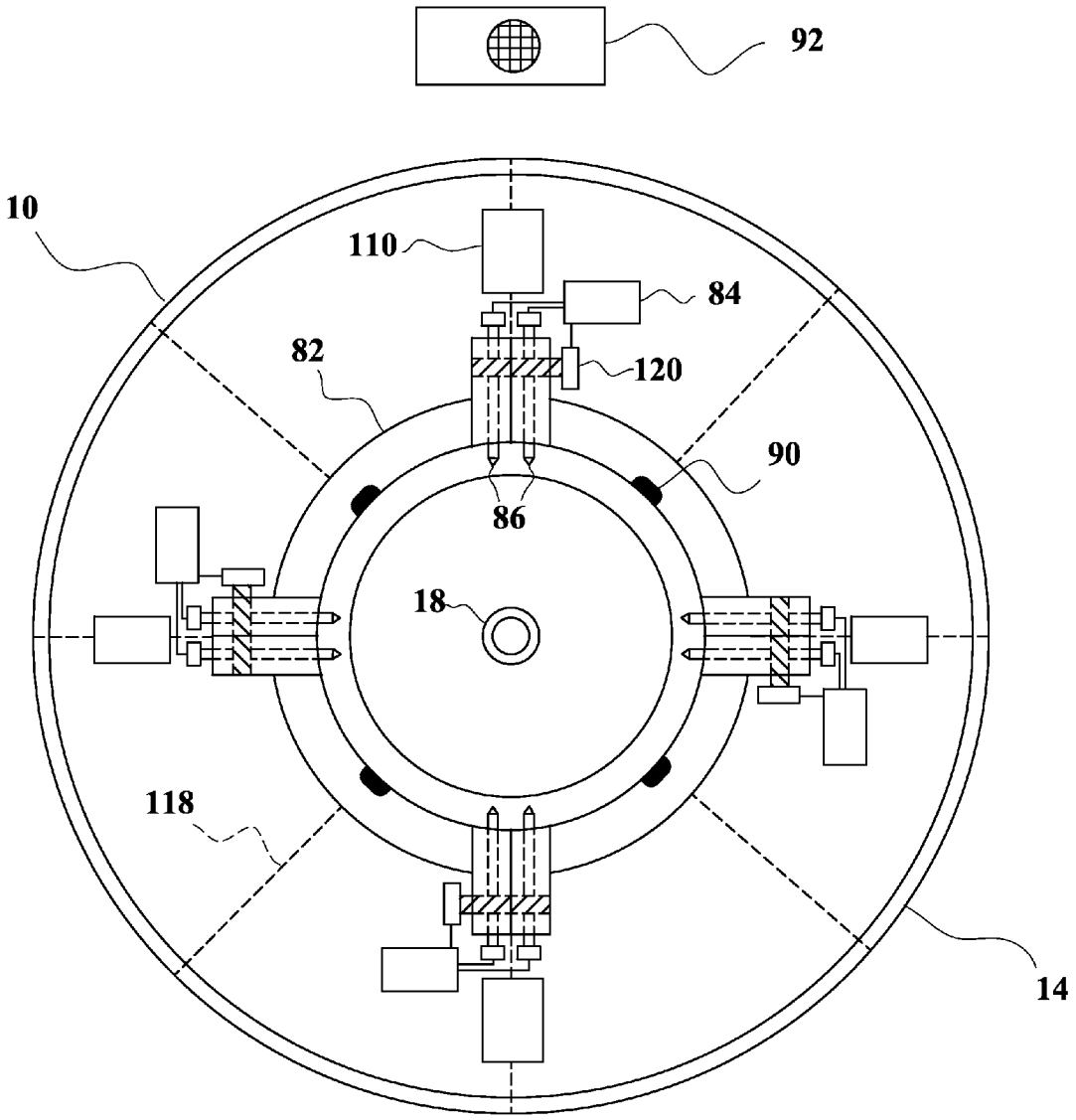
FIG. 22 is a horizontal sectional view drawn along lines 22-22 of FIG. 17, showing the seventh preferred embodiment of the invention.

A locking collar 82, attached to the sleeve, can lock the sleeve around the portion of the well pipe adjacent to the open end of the well pipe. As shown in FIG. 22, a power source 84 for locking the locking collar using bolts 120 can apply sufficient force to pierce the well pipe and lock the locking collar onto the well pipe using attachment members 86, without causing the well pipe to collapse. Preferably, the sleeve and the locking collar are generally cylindrical. The attachment members preferably are evenly spaced around the locking collar. Preferably, the sleeve has an interior surface 88 that can grip an exterior surface of the well pipe. Preferably, there are one or more pressure sensors (90 in FIG. 22) and an alerting system 92 that is activated when the pressure sensors detect excessive pressure of the sleeve against the well pipe, to prevent the well pipe from being collapsed. The connection between the sensors and the alerting system may be wired or wireless. Alerts may be audible, visible, etc. Preferably, a sharp edge 94 extends from a lower rim 96 of the sleeve, by which irregularities in the well pipe can be cut.

2. Positioning Rings

Figure 23:
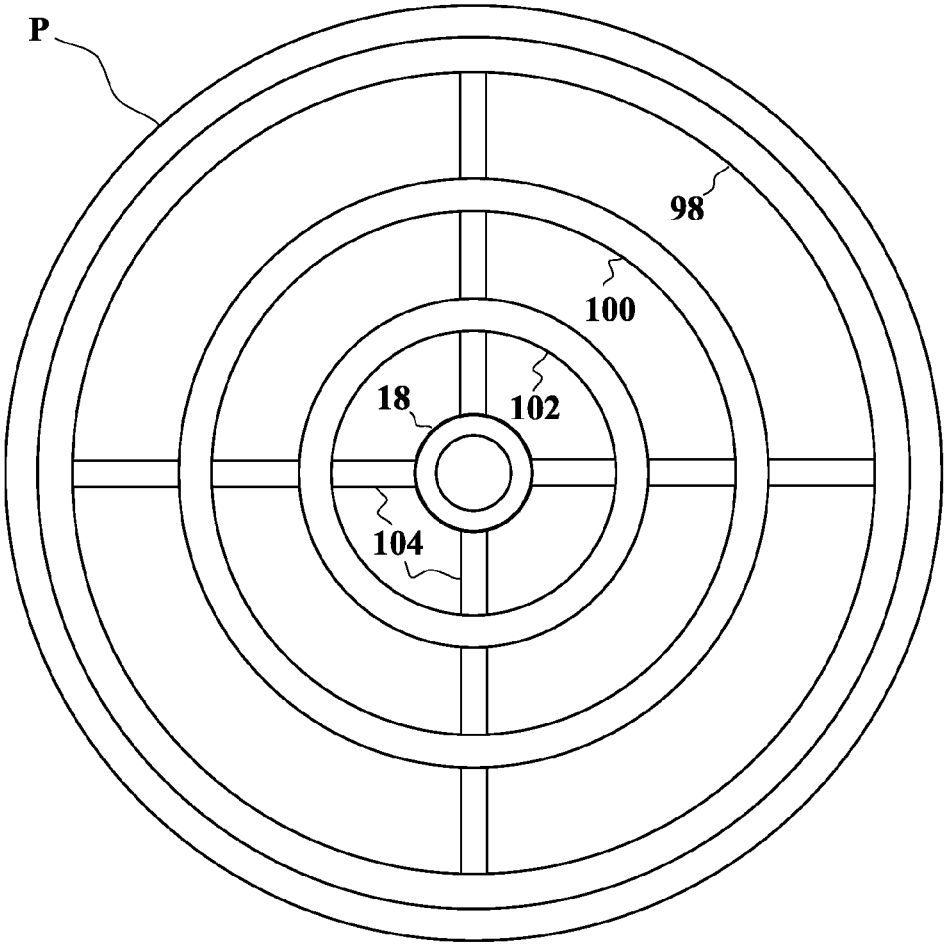
FIG. 23 is a top view of the well pipe with the cylindrical positioning rings inserted, in the seventh preferred embodiment of the invention.
Figure 24:
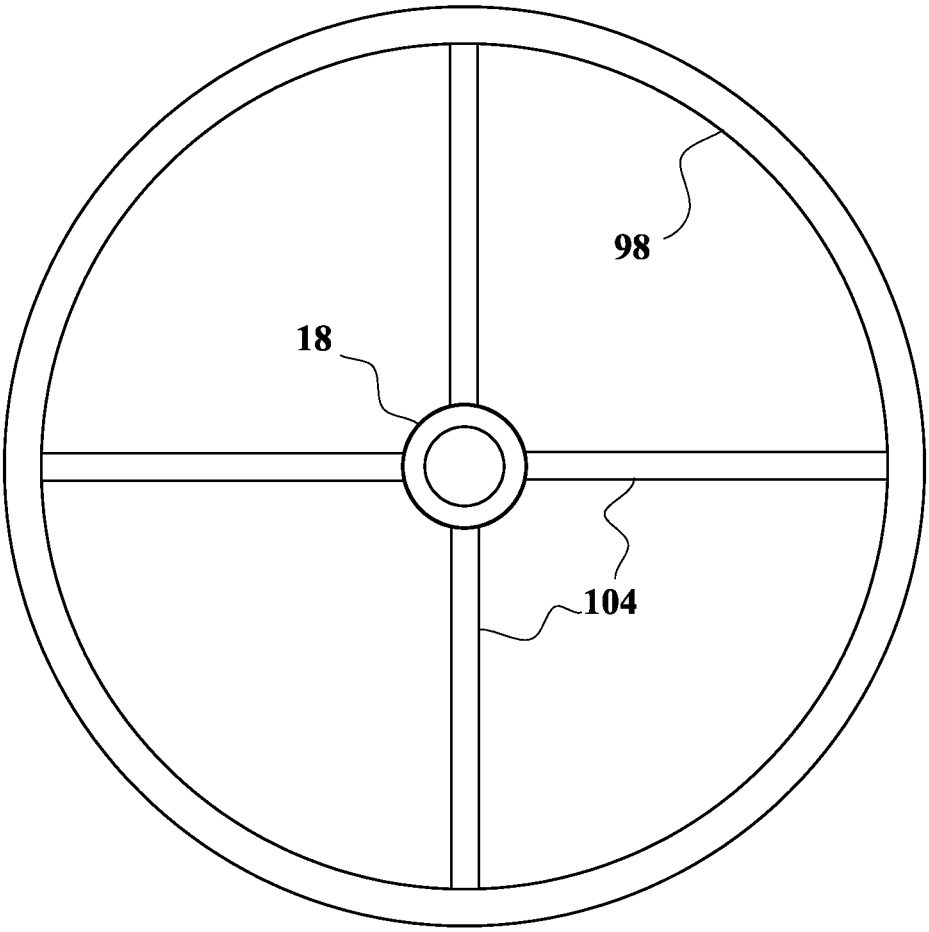
FIG. 24 is a top detail view of the largest positioning ring, in the seventh preferred embodiment of the invention.
Figure 25:
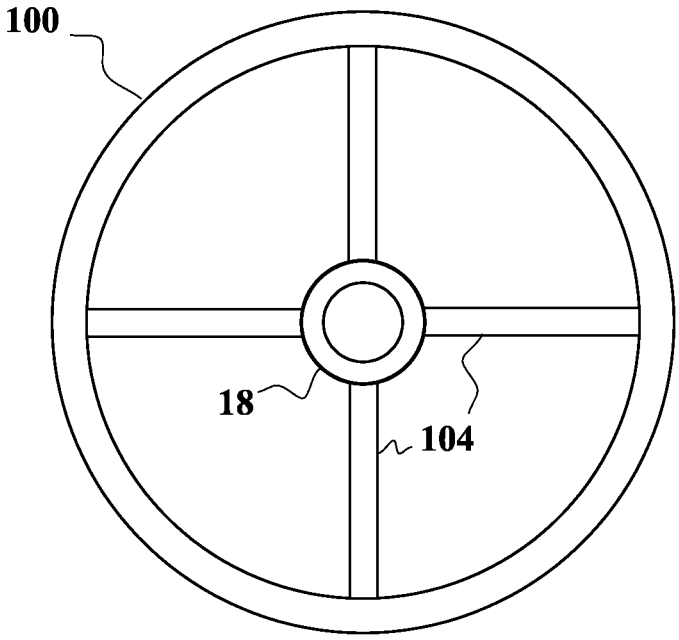
FIG. 25 is a top detail view of the middle positioning ring, in the seventh preferred embodiment of the invention.
Figure 26:
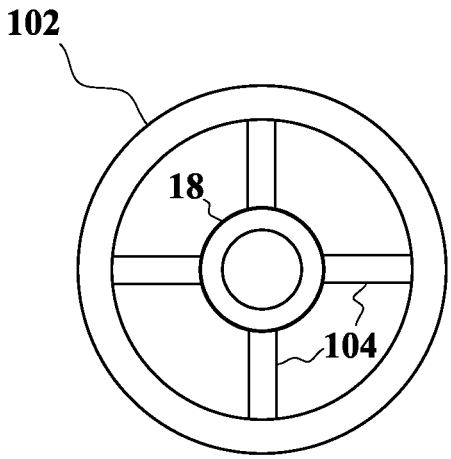
FIG. 26 is a top detail view of the smallest positioning ring, in the seventh preferred embodiment of the invention.

One or more positioning rings 98, 100 and 102 are attached to the high pressure pipe, that can fit inside the well pipe P. Preferably, there are a plurality of the positioning rings, that are attached by arms (104 in FIGS. 23-26) to the high pressure pipe, with the diameters of the rings increasing with their distance from an open end of the high pressure pipe. Preferably, the positioning rings are generally cylindrical. The positioning ring 98 at the greatest distance from the open end of the high pressure pipe has a beveled lower rim (106 in FIGS. 17-19). This ring preferably has an outside diameter at or just under the inside diameter of the well pipe. The main purpose of the positioning rings is to make it easier to correctly position the funnel and sleeve over the well pipe, but they can also contribute to the Bernoulli effect. FIG. 23 shows all of the rings positioned inside the well pipe P. FIGS. 24-26 show each of the rings separately. (There may be a different number of positioning rings from what is shown in the drawings.)

3. Cutting Devices

One or more cutting devices 108 are attached to one or more extension arms 110, that can cut the well pipe. Preferably, the extension arms are moveable, and the cutting devices can rotate around the well pipe. The cutting devices may be lasers, electric saws, pneumatic or hydraulic cutters, or any other suitable means for neatly cutting the well pipe, so that bent or ruptured portions of the well pipe can be removed, to allow the invention to be attached to an intact portion of the well pipe.

4. Funnel is Adjustable and Removable

The slope between the smaller end 12 and the larger end 14 of the funnel 10 can be adjusted. The funnel is shown in a lowered position in FIGS. 17 and 20, and in a raised position in FIGS. 18 and 21. (The possible positions of the funnel are not limited to the two positions shown.) The funnel is comprised of leaves (114 in FIGS. 20 and 21) that are pivotally connected by joints (116 in FIGS. 17 and 18) to the return pipe 16. The seams 118 are closed when the funnel is in a lowered position (as in FIG. 20) and separated with the funnel is in a raised position (as in FIG. 21). The funnel can be removed and raised to the surface of a body of liquid with the aid of floats 112 attached to the funnel. The leaves may be released from the joints by mechanical means, by an explosive charge, or by any other suitable means. The funnel can be reused after it is separated. The floats may be permanently buoyuant, or inflated when needed.

The invention also encompasses a method of recovering from blowouts, including the steps of:

placing a larger end of a funnel adjacent to an open end of a well pipe through which a first fluid is escaping, the funnel having a smaller end that is connected to a return pipe;

moving the funnel into alignment with the well pipe, with the aid of one or more positioning rings attached to the high pressure pipe, that can fit inside the well pipe;

fastening a sleeve over a portion of the well pipe adjacent to the open end of the well pipe, said sleeve being connected to the return pipe;

locking the sleeve around the pipe from which the first fluid is escaping, using a locking collar attached to the sleeve;

inserting a high pressure pipe into the well pipe;

pumping the second fluid, at a higher pressure than that of the first fluid, through the high pressure pipe into the well pipe;

separating the first fluid by the second fluid in a space adjacent to an end of the high pressure pipe that has been inserted into the well pipe; and accelerating a portion of the first fluid that is not held back by the greater pressure of the second fluid, causing it to flow through the sleeve and the return pipe at an increased velocity, but at a reduced pressure due to the Bernoulli effect, thus supplying suction that helps to move the funnel down onto the well pipe.

It is to be understood that the present invention is not limited to the embodiments described above, but encompasses any and all embodiments within the scope of the following claims.

I claim:

1. A blowout recovery valve, comprising:

a valve having a smaller end and a larger end, with the larger end being suitably dimensioned and configured to be placed over an open end of a well pipe through which a first fluid is escaping;

a return pipe connected to the smaller end of the valve;

a sleeve, suitably dimensioned and configured to be placed over a portion of the well pipe adjacent to the open end of the well pipe, with the sleeve being connected to the return pipe;

a high pressure pipe passing through the valve, suitably dimensioned and configured to be insertable into the well pipe; and wherein, when a second fluid is pumped through the high pressure pipe at a pressure greater than that of the first fluid, the first fluid will be separated by the second fluid in a space adjacent to an end of the high pressure pipe that has been inserted into the well pipe, and a portion of the first fluid that is not held back by the greater pressure of the second fluid will flow through the sleeve and the return pipe at an accelerated velocity, but at a reduced pressure due to the Bernoulli effect, thus supplying suction to help move the valve down onto the well pipe.

2. The blowout recovery valve according to claim 1, further comprising:

a locking collar, attached to the sleeve, that can lock the sleeve around the portion of the well pipe adjacent to the open end of the well pipe.

3. The blowout recovery valve according to claim 2, further comprising:

a power source for locking the locking collar;

wherein said power source can apply sufficient force to pierce the well pipe and lock the locking collar onto the well pipe, without causing the well pipe to collapse.

4. The blowout recovery valve according to claim 3, wherein:

the sleeve and the locking collar are generally cylindrical; and attachment members are evenly spaced around the locking collar, that can pierce the well pipe and lock the locking collar onto the well pipe.

5. The blowout recovery valve according to claim 1, wherein:

the sleeve has an interior surface that can grip an exterior surface of the well pipe.

6. The blowout recovery valve according to claim 1, further comprising:

one or more pressure sensors; and an alerting system that is activated when the pressure sensors detect excessive pressure of the sleeve against the pipe.

7. The blowout recovery valve according to claim 1, further comprising:

one or more positioning rings attached to the high pressure pipe, that can fit inside the well pipe.

8. The blowout recovery valve according to claim 7, wherein:

there are a plurality of the positioning rings, that are attached by arms to the high pressure pipe, with the diameters of the rings increasing with their distance from an open end of the high pressure pipe.

9. The blowout recovery valve according to claim 8, wherein:

the positioning rings are generally cylindrical;

the positioning ring at the greatest distance from the open end of the high pressure pipe has a beveled lower rim; and the positioning rings contribute to the Bernoulli effect.

10. The blowout recovery valve according to claim 1, wherein:

a sharp edge extends from a lower rim of the sleeve, by which irregularities in the well pipe can be cut.

11. The blowout recovery valve according to claim 1, further comprising:

one or more cutting devices attached to one or more extension arms, that can cut the well pipe.

12. The blowout recovery valve according to claim 11, wherein:

the extension arms are moveable, and the cutting devices can rotate around the well pipe.

13. The blowout recovery valve according to claim 1, wherein:

the slope between the smaller end and the larger end of the valve can be adjusted; and the valve can be removed and raised to the surface of a body of liquid with the aid of floats attached to the valve.

14. A blowout recovery valve, comprising:

a valve having a smaller end and a larger end, with the larger end being dimensioned and configured to be placed over an open end of a well pipe through which a first fluid is escaping;

a return pipe connected to the smaller end of the valve;

a high pressure pipe passing through the valve, suitably dimensioned and configured to be insertable into the pipe through which the first fluid is escaping; and one or more positioning rings attached to the high pressure pipe, that can fit inside the well pipe;

wherein, when a second fluid is pumped through the high pressure pipe at a pressure greater than that of the first fluid, the first fluid will be separated by the second fluid in a space adjacent to an end of the high pressure pipe that has been inserted into the well pipe, and a portion of the first fluid that is not held back by the greater pressure of the second fluid will flow through the valve and the return pipe at an accelerated velocity, but at a reduced pressure due to the Bernoulli effect, thus supplying suction that helps to move the valve down onto the well pipe.

15. The blowout recovery valve according to claim 14, wherein:

there are a plurality of the positioning rings, that are attached by arms to the high pressure pipe, with the diameters of the rings increasing with their distance from an open end of the high pressure pipe.

16. The blowout recovery valve according to claim 15, wherein:

the positioning rings are generally cylindrical;

the positioning ring at the greatest distance from the open end of the high pressure pipe has a beveled lower rim; and the positioning rings contribute to the Bernoulli effect.

17. The blowout recovery valve according to claim 14, further comprising:

one or more cutting devices attached to one or more extension arms, that can cut the well pipe.

18. A method of recovering from blowouts, comprising the steps of:

placing a larger end of a valve adjacent to an open end of a well pipe through which a first fluid is escaping, the valve having a smaller end that is connected to a return pipe;

moving the valve into alignment with the well pipe;

fastening a sleeve over a portion of the well pipe adjacent to the open end of the well pipe, said sleeve being connected to the return pipe;

inserting a high pressure pipe into the well pipe;

pumping a second fluid, at a higher pressure than that of the first fluid, through the high pressure pipe into the well pipe;

separating the first fluid by the second fluid in a space adjacent to an end of the high pressure pipe that has been inserted into the well pipe; and accelerating a portion of the first fluid that is not held back by the greater pressure of the second fluid, causing it to flow through the sleeve and the return pipe at an increased velocity, but at a reduced pressure due to the Bernoulli effect, thus supplying suction that helps to move the valve down onto the well pipe.

19. The method of recovering from blowouts according to claim 18, comprising the further step of:

locking the sleeve around the pipe from which the first fluid is escaping, using a locking collar attached to the sleeve.

20. The method of recovering from blowouts according to claim 18, wherein:

the valve is moved into alignment with the well pipe, with the aid of one or more positioning rings attached to the high pressure pipe, that can fit inside the well pipe.

* * * * *